US007287624B2

(12) United States Patent
Itoh et al.

(10) Patent No.: US 7,287,624 B2
(45) Date of Patent: Oct. 30, 2007

(54) DOUBLE DECK ELEVATOR

(75) Inventors: Hiroaki Itoh, Fuchu (JP); Hideya Kohara, Fuchu (JP); Masahir Hayakawa, Hachioji (JP); Gen Yokoi, Fuchu (JP)

(73) Assignee: Kabushiki Kaisha Toshiba, Kawasaki-shi (JP)

( * ) Notice: Subject to any disclaimer, the term of this patent is extended or adjusted under 35 U.S.C. 154(b) by 0 days.

(21) Appl. No.: 10/620,384

(22) Filed: Jul. 17, 2003

(65) Prior Publication Data

US 2004/0094369 A1 May 20, 2004

Related U.S. Application Data

(62) Division of application No. 09/795,357, filed on Mar. 1, 2001, now Pat. No. 6,615,952.

(30) Foreign Application Priority Data

Mar. 2, 2000 (JP) ..... 2000-56981
Dec. 25, 2000 (JP) ..... 2000-392049

(51) Int. Cl.
*B66B 9/00* (2006.01)
*B66B 11/02* (2006.01)
*B66B 7/00* (2006.01)

(52) U.S. Cl. ..... 187/249; 187/401; 187/414

(58) Field of Classification Search ..... 187/401, 187/414, 249, 269, 402
See application file for complete search history.

(56) References Cited

U.S. PATENT DOCUMENTS 1,738,729 A 12/1929 Richardson
3,982,718 A * 9/1976 Folkenroth et al. ..... 187/269
4,058,191 A 11/1977 Balbo
4,723,627 A 2/1988 Ito
4,941,797 A * 7/1990 Smillie, III ..... 187/269
5,377,784 A 1/1995 Walkowiak et al.
5,960,910 A 10/1999 Traktovenko

FOREIGN PATENT DOCUMENTS

| | | |
|---|---|---|
| EP | 982260 | 3/2000 |
| GB | 2280662 | 8/1995 |
| JP | 3158377 | 7/1991 |
| JP | 4298482 | 10/1992 |
| JP | 5186170 | 7/1993 |
| JP | 06255955 A * | 9/1994 |
| JP | 09077436 A * | 3/1997 |
| JP | 2002179368 A * | 6/2002 |

* cited by examiner

*Primary Examiner*—Gene O. Crawford
*Assistant Examiner*—Rakesh Kumar
(74) *Attorney, Agent, or Firm*—Finnegan, Henderson, Farabow, Garrett & Dunner, L.L.P.

(57) ABSTRACT

A double deck elevator comprising an upper cage and a lower cage vertically movable together in a hositway, wherein a space between the upper cage and the lower cage is covered by covers. The covers guide airflow flowing around the space to reduce air turbulence noise, and consequently the quietness and comfortableness in the cages is improved.

14 Claims, 23 Drawing Sheets

DOUBLE DECK ELEVATOR

This is a divisional of application Ser. No. 09/795,357, filed Mar. 1, 2001, now U.S. Pat. No. 6,615,952 which is incorporated herein by reference.

BACKGROUND OF THE INVENTION

1. Field of the Invention

The present invention relates to a double deck elevator comprising an upper cage and a lower cage vertically movable together in a hoistway, and more particularly to a double deck elevator wherein a space existing between the upper cage and the lower cage is covered with covers for reducing air turbulence noise to improve quietness and comfortableness in the cages.

2. Description of the Related Art

In conventional double deck elevators shown in FIGS. 23, 24 and 25, a hoistway 1 is provided with a pair of guide rails 2 vertically extending along the inner walls of the hoistway 1 respectively, and a cage assembly 3 hoisted by a main rope 4 is arranged between the guide rails 2 to move vertically guided by the guide rails 2.

The cage assembly 3 comprises a cage frame 5, an upper cage 6 and a lower cage 7 mounted on the cage frame 5 respectively. A plurality of guide means 8, which have guide rollers 8*a* rolling on the respective guide rails 2, are provided at a top-side, a bottom-side, left and right sides of the cage frame 5.

On a middle beam 9 and a bottom beam 10 of the cage frame 5, cage receiving frames 11 and 12 are mounted respectively. Between the cage receiving frame 11 and the bottom of the upper cage 6, and between the cage receiving frame 12 and the bottom of the lower cage 7, load cells 13 are inserted with vibroisolating rubbers 14 respectively. The weights of the upper cage and lower cages 6, 7 respectively detected by the load cells 13 are used for various purposes.

Displacement sensors 15 are provided between the bottom surface of the upper cage 6 and the middle beam 9, and between the bottom surface of the lower cage 7 and the bottom beam 10 respectively, so that-the displacement of the upper and lower cages 6, 7 can be detected respectively.

As mentioned above, the cage assembly 3 is hoisted by the main rope 4. In a case of 1:1 roping system, the main rope 4 is directly connected to the upper beam 16 of the cage frame 5 (FIG. 24). And in a case of 2:1 roping system, the main rope 4 is wound around sheaves 17 provided on the upper beam 16 of the cage frame 5 (FIG. 25).

When the upper and lower cages 6, 7 arrive the floors called by passengers respectively, the cage doors 18 of the cages 6, 7 face the hall doors 19 of the floors and are opened and closed by a door-driving unit 20. Hall sills 21 are provided on the floors, and cage sills 22 are provided on the floors of the upper and lower cages 6, 7 respectively, such that doors can open and close smoothly.

In the conventional double deck elevators described above, a space "S" exists between the upper cage 6 and the lower cage 7 and the door-driving unit is installed in the space "S". When the upper and lower cages move vertically in the hoistway 1, airflow flowing around the cages enters the space "S" and comes into collision with the door-driving unit 20 and generates air turbulence. The air turbulence results in big noise that disturbs quietness and comfortableness in the upper and lower cages 6, 7.

SUMMARY OF THE INVENTION

It is therefore a general object of the present invention to provide a double deck elevator that can reduce air turbulence noise and improve quietness and comfortableness in the cages.

This object can be achieved by covering a space existing between an upper cage and a lower cage with covers for covering the space at a door-side, two lateral-sides and a backside of the space.

According to the present invention, since the space is covered with the covers, airflow flowing around the cages cannot enter the space and do not come into collisions with any devices arranged in the space, then the air do not cause any air turbulences. Consequently, noise caused by air turbulences is reduced and quietness and comfortableness in the cages is improved.

Since the covers stabilize the airflow, the air resistance of the cages is reduced and the vertical moving speed of the cages can be increased.

Since the space between the upper and lower cages is isolated from a general space in the hoistway by the covers, noise in the hoistway caused by the vertical moving of the cages cannot enter the cages through the space, and quietness and comfortableness in the cages is further improved.

The covers is attached to at least one of the upper cage, the lower cage and the cage frame on which the cages are mounted respectively, via elastic material to absorb vertical distance change between the cages.

For reducing air turbulence noise in the hoistway, and for reducing the air resistance of the cages, capsule type air guiding members can be arranged above the upper cages and below the lower cages respectively. The air guiding members guide the airflow into clearances between the inner walls of the hoistway and the outer side surfaces of the cages.

The door-side cover is positioned closer to the door-side inner wall of the hoistway than a door-driving unit that opens and closes the doors of the cages, to prevent the airflow from entering the space and coming into collision with the door-driving unit. In this case, the door-side cover is provided with slits through which the door links connecting the doors to the door-driving unit are inserted respectively. And the door-side cover is provided with slit-closing members that close a clearance between the periphery of the slit and the door link, to prevent the airflow from entering the space through the slit and causing the air turbulence noise.

When the double deck elevator comprises a falling matter catching member for catching falling matters, such as dust or water, falling through a clearance between the door-side inner wall of the hoistway and the upper cage, the door-side cover is provided with an opening through which the falling matter catching member approaches and moves apart from the door-side inner wall of the hoistway. And the door-side cover is provided with an opening-closing member for closing the opening, and/or a clearance-closing member for closing a clearance between the falling matter catching member and the door-side cover, to prevent airflow from entering the space through the-opening and/or through the clearance, and to prevent airflow from causing the air turbulence noise.

In addition, this application is based on Japanese Patent Application No.2000-56981 and Japanese Patent Application No.2000-392049, the content of which is incorporated hereinto by reference.

BRIEF DESCRIPTION OF THE DRAWINGS

For a better understanding of the invention as well as other objects and features thereof, reference is made to the following detailed description to be read in conjunction with the accompany drawings, and like reference characters designate corresponding parts in the several views, wherein:

FIGS. 1A and 1B are schematic front and side elevation views showing a double deck elevator of the present invention, in which FIG. 1A is a sectional drawing along the line X-X in FIG. 1B, and FIG. 1B is a sectional drawing along the line Y-Y in FIG. 1A.

DETAILED DESCRIPTION OF THE PREFERRED EMBODIMENTS

Figure 1:
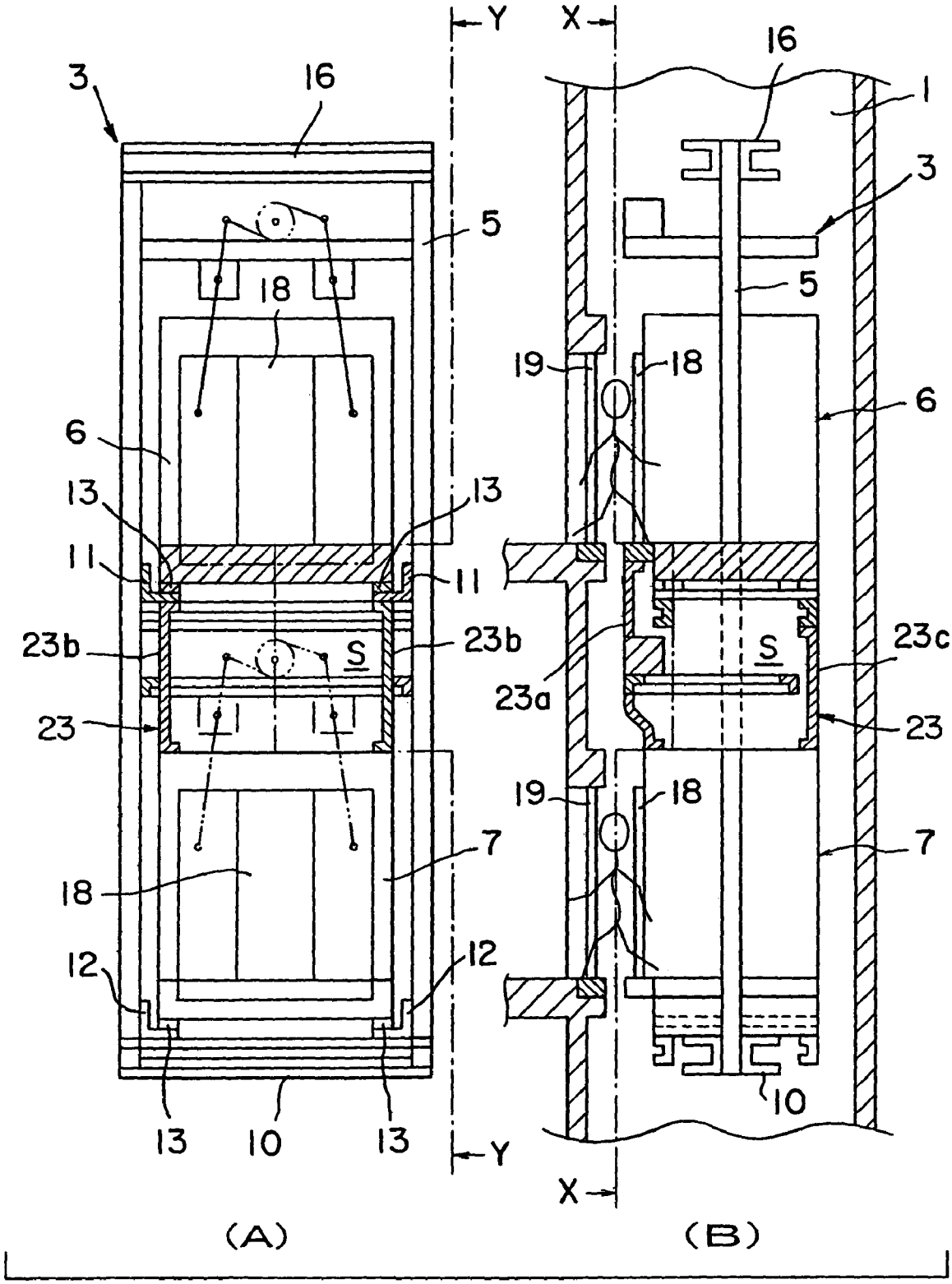

Referring to the attached drawings, in FIGS. 1A and 1B, there is shown a double deck elevator comprising an upper cage 6 and a lower cage 7 vertically movable together in a hoistway 1.

A space "S" existing between the upper cage 6 and the lower cage 7 is covered by the covers 23 including a door-side cover 23*a*, two lateral-side covers 23*b* and a backside cover 23*c*. That is, the space "S" is covered at a door-side, two lateral-sides and backside respectively.

Figure 2:
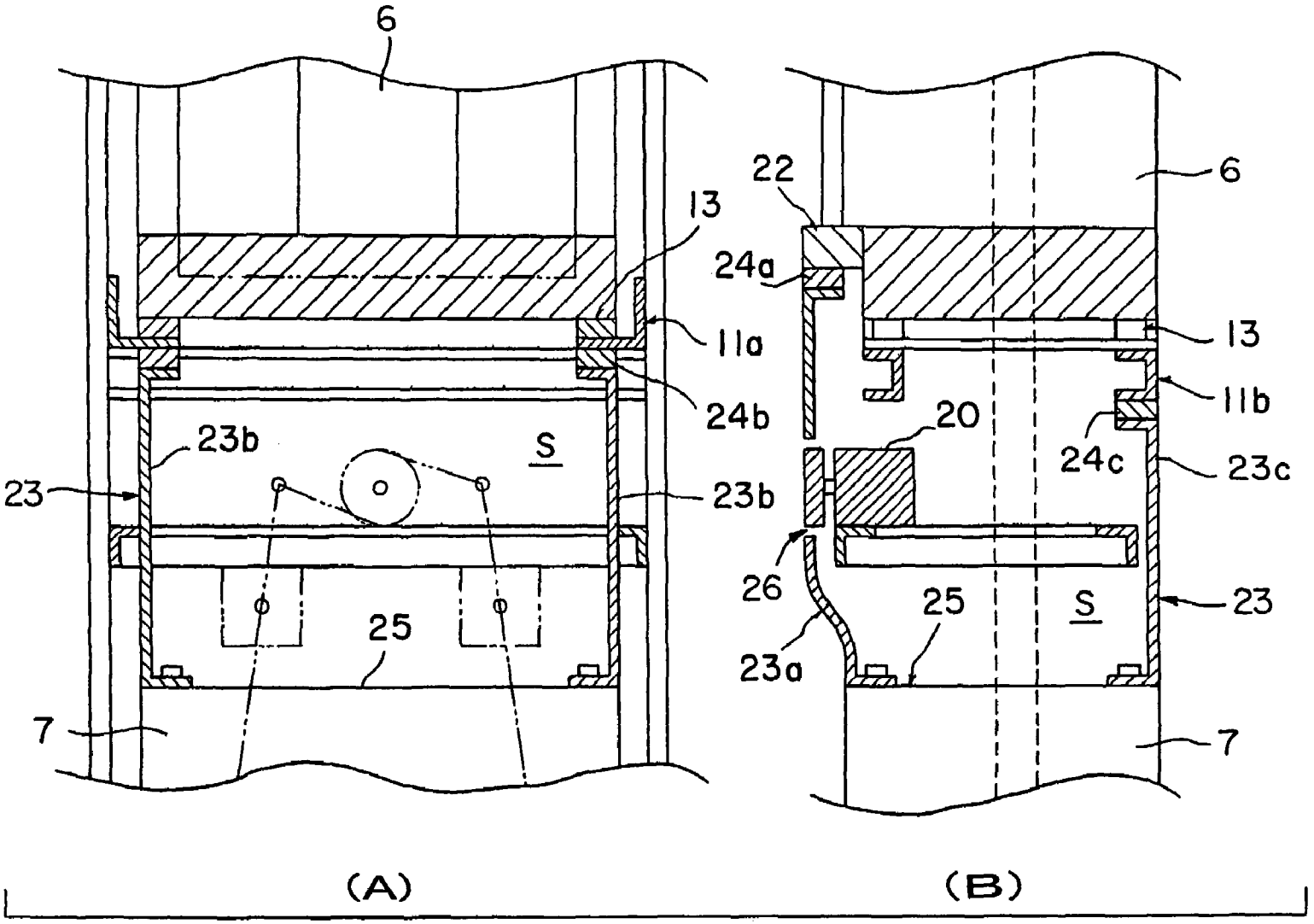
FIGS. 2A and 2B are enlarged sectional front and side elevation views of the covers shown in FIGS. 1A and 1B.

As shown in FIGS. 2A and 2B, the door-side cover 23*a* is formed so that its bottom half curves into the space "S" to absorb horizontal position difference between a sill 22 of the upper cage 6 and a ceiling 25 of the lower cage 7. And, all of these covers have smooth flat outer surfaces that are connected to the outer side surfaces of the upper and lower cages 6, 7 each other without steps. And the door-side cover 23*a* is provided with an opening 26 into which the front portion of a door-driving unit 20 is inserted.

This construction enables airflow to flow smoothly around the space and cages 6, 7, and prevent the airflow from entering the space and coming into collisions with devices arranged in the space "S" when the cages 6, 7 move vertically in the hoistway 1. Consequently, noise caused by airflow turbulence and air resistance of the cages are reduced.

As shown in FIGS. 1A and 1B, since the upper and lower cages 6, 7 are supported on the floor receiving frames 11, 12 respectively by means of vibroisolating rubber 13, vertical distance between the upper and lower cages 6, 7 changes due to the weight changes of the cages 6, 7.

However, as shown in FIGS. 2A and 2B, the top edge of the door-side cover 23*a* is fixed to a cage sill 22 by means of an elastic material 24*a*, and its bottom edge is directly fixed to a ceiling 25 of the lower cage 7. Also, the top edges of the lateral-side covers 23*b* are attached to a frame 11*a* extending from a door-side to a backside within a cage frame 5 by means of a elastic material 24*b*, and its bottom edge is directly fixed to the ceiling 25 of the lower cage 7. Further, the top edge of the backside cover 23*c* is attached to the floor receiving frame lib extending between two lateral-sides by means of a elastic material 24*c*, and its bottom edge is directly fixed to the ceiling 25 of the lower cage 7. These elastic material 24*a*, 24*b* and 24*c*, such as rubber block, absorb the vertical distance change between the cages 6, 7 and prevent the deformation of the covers.

In addition, it is possible to insert an elastic material between the bottom edges of the covers and the ceiling 25 of the lower cage 7.

Figure 3:
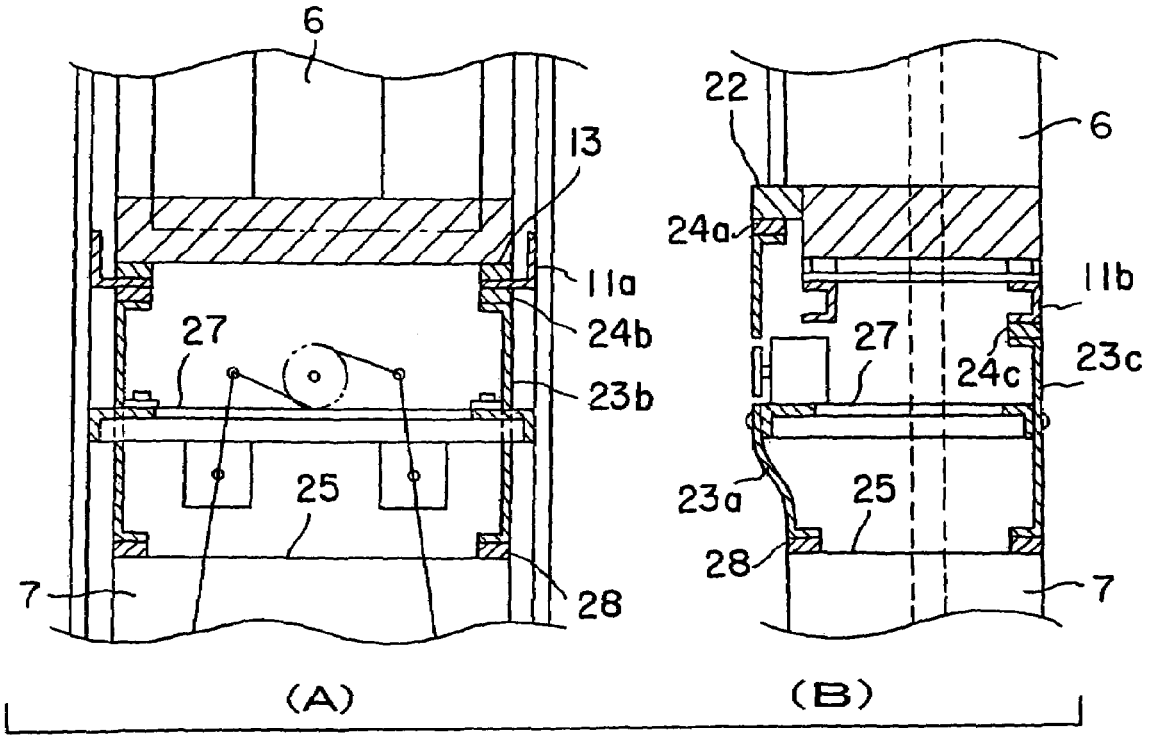
FIGS. 3A and 3B are enlarged sectional front and side elevation views of the covers of another embodiment.

In an embodiment of the double deck elevator shown in FIGS. 3A and 3B, the door-side cover 23*a*, the two lateral-side covers 23*b* and the backside cover 23*c* are fixed to the middle cage frame 27 at vertical middle portions thereof respectively. And, elastic materials 24*a*, 24*b* and 24*c* are inserted between the top edges of the respective covers and the sill 20 or the floor receiving frame 11*a* and 11*b* of the upper cage. Also elastic materials 28 are inserted between the bottom edge of the respective covers and the ceiling 25 of the lower cage 7. Accordingly, these elastic materials 24*a*, 24*b*, 24*c* and 28 absorb distance change between the cages 6, 7 and prevent the deformation of the covers.

Figure 4:
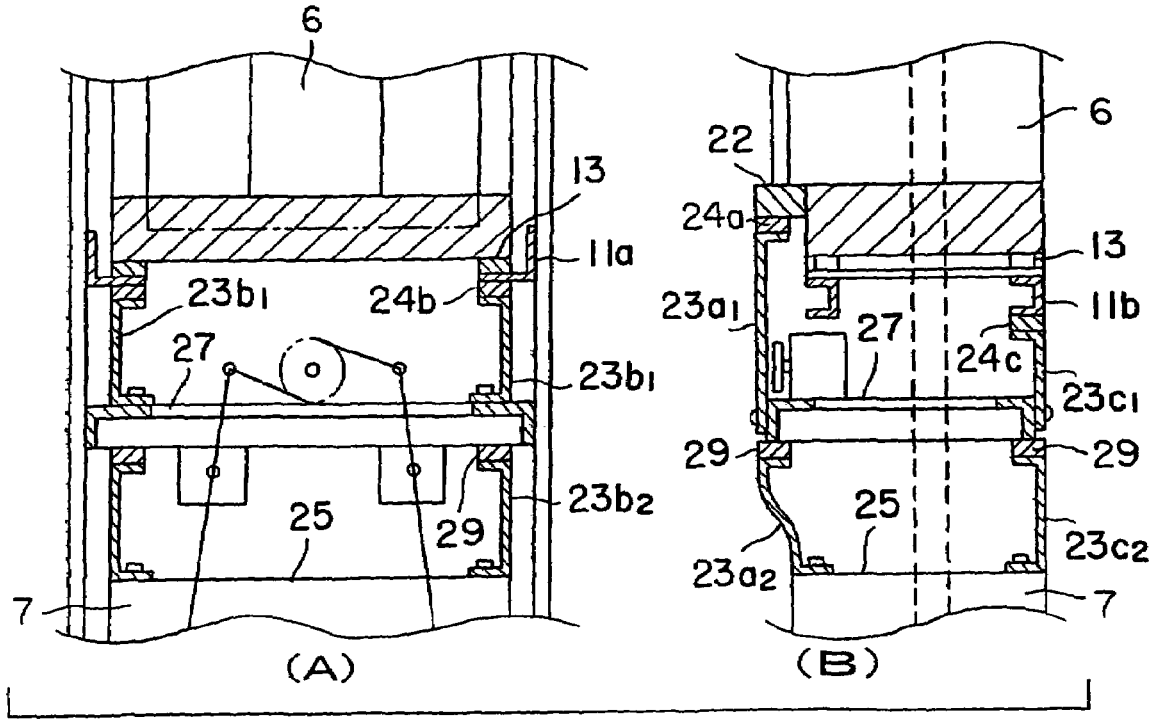
FIGS. 4A and 4B are enlarged sectional front and side elevation views of the covers of another embodiment.

In an embodiment of the double deck elevator shown in FIGS. 4A and 4B, respective covers are divided into upper and lower pieces. That is, the door-side cover 23*a* consists of upper piece 23*a*1 and the lower piece 23*a*2, the two lateral-side covers consist of upper pieces 23*b*1 and lower pieces 23*b*2, also the backside cover consists of upper piece 23*c*1 and lower piece 23*c*2. Bottom edges of the upper pieces 23*a*1, 23*b*1 and 23*c*1 are directly fixed to the cage frame 27, and the top edges of them are fixed to the sill 22 of the upper cage6, floor receiving frame 11*a* and 11*b* by means of elastic material 24*a*, 24*b* and 24*b* respectively. And, the bottom edges of the lower pieces 23*a*2, 23*b*2 and 23*c*2 are directly fixed to the ceiling 25 of the lower cage 7, and the top edges of them are fixed to the cage frame 27 by means of elastic material 29 respectively. Accordingly, these elastic materials 24*a*, 24*b*, 24*c*, 28 and 29 absorb distance change between the cages 6, 7 and avoid the deformation of the covers.

In addition, it is possible to fix the bottom edges of the upper pieces 23*a*1, 23*b*1 and 23*c*1 by means of the elastic materials 24*a*, 24*b* and 24*b* respectively, and to directly fix the top edges of them to the sill 22 of the upper cage6, floor receiving frame la and lib respectively. Also, it is possible to fix bottom edges of the lower pieces 23*a*2, 23*b*2 and 23*c*2 by means of elastic materials 29 respectively, and to directly fix the top edges of them to the cage frame 27 respectively.

Figure 5:
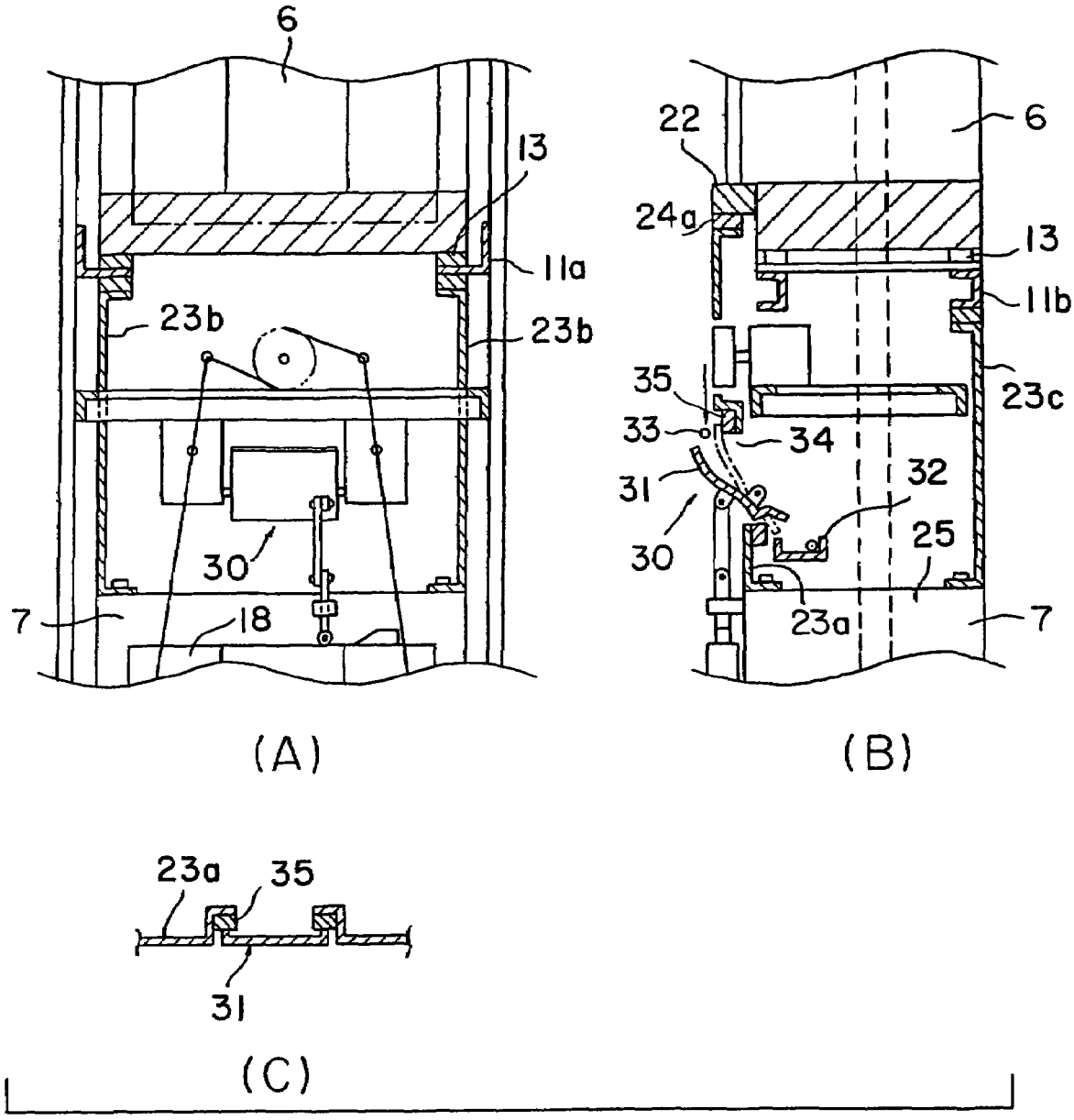
FIGS. 5A, 5B are enlarged sectional front and side views of the covers of another embodiment.
FIG. 5C is a sectional plan view of the falling matter catching member shown in FIGS. 5A and 5B.

In an embodiment of the double deck elevator shown in FIGS. 5A and 5B, there is provided a falling matter catching device 30 at a door-side of the space between cages 6, 7, which catches the falling matters, such as dust or water falling through a clearance between a door-side inner wall of the hoistway 1 and the upper cage 6. This falling matter catching device 30 has a falling matter catching plate 31 that swings around a horizontal axis to approach and move apart from the door-side inner wall of the hoistway 1, and a receiving dish 32 arranged in the space for receiving the falling matters caught by the catching plate 31.

When the catching-plate 31 swings to approach the door-side inner wall of the hoistway 1 as shown in FIGS. 5A and 5B by the solid lines, the catching plate 31 catches the falling matters 33 and guides them to the receiving dish 32 to protect passengers entering or exiting the lower cage 7 from such falling matters.

The door-side cover 23*a* is provided with an opening 34 which is opened and closed by the catching plate 31, and is provided with an opening closing member 35 attached along the periphery of the opening 34 that closes a clearance between the catching plate 31 and the periphery of the opening 34 when the catching plate 31 closes the opening 34 as shown in FIG. 5B by the phantom lines.

Since the airflow flowing along the door-side cover 23*a* is guided by the front cover 23*a* and the catching plate 31, air turbulence noise is reduced. Furthermore, the catching plate 31 blocks out the line of vision of a passenger ay the entrance of the lower cage 7 who looks up the passengers entering and exiting the upper cage 6.

Figure 6:
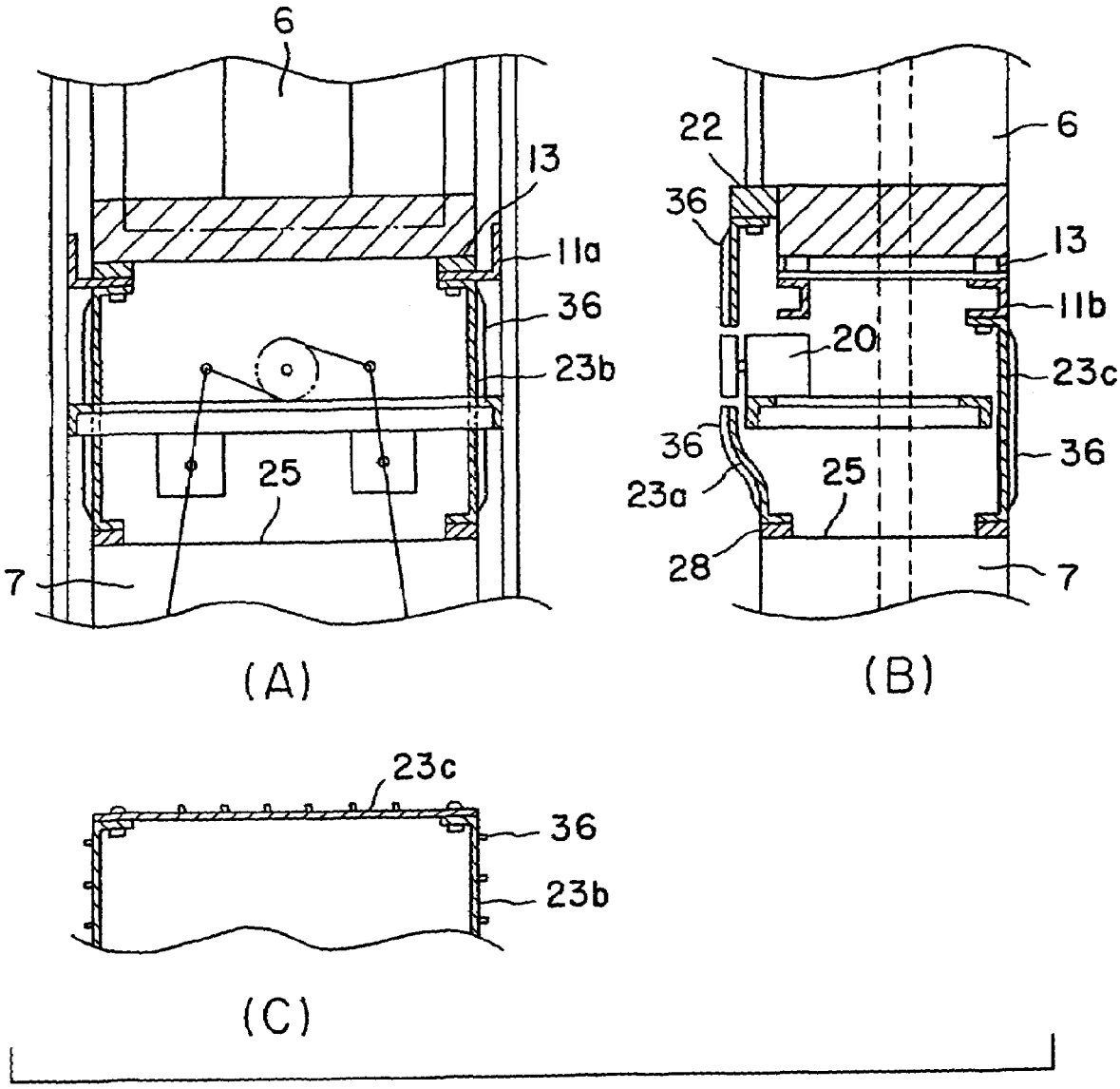
FIGS. 6A, 6B are sectional front and side elevation views of the covers of another embodiment,.
FIG. 6C is a plan view of the covers shown in FIGS. 6A and 6B.

In an embodiment of the double deck elevator shown in FIGS. 6A and 6B, a lot of airflow guiding plates 36 extending vertically are provided on the outer surfaces of the door-side cover 23*a*, two lateral-side covers 23*b* and the backside cover 23*c*. The airflow guiding plates 36, as airflow protrusions, guide and stabilize the airflow flowing along the outer surfaces of the covers to reduce air turbulence noise.

Figure 7:
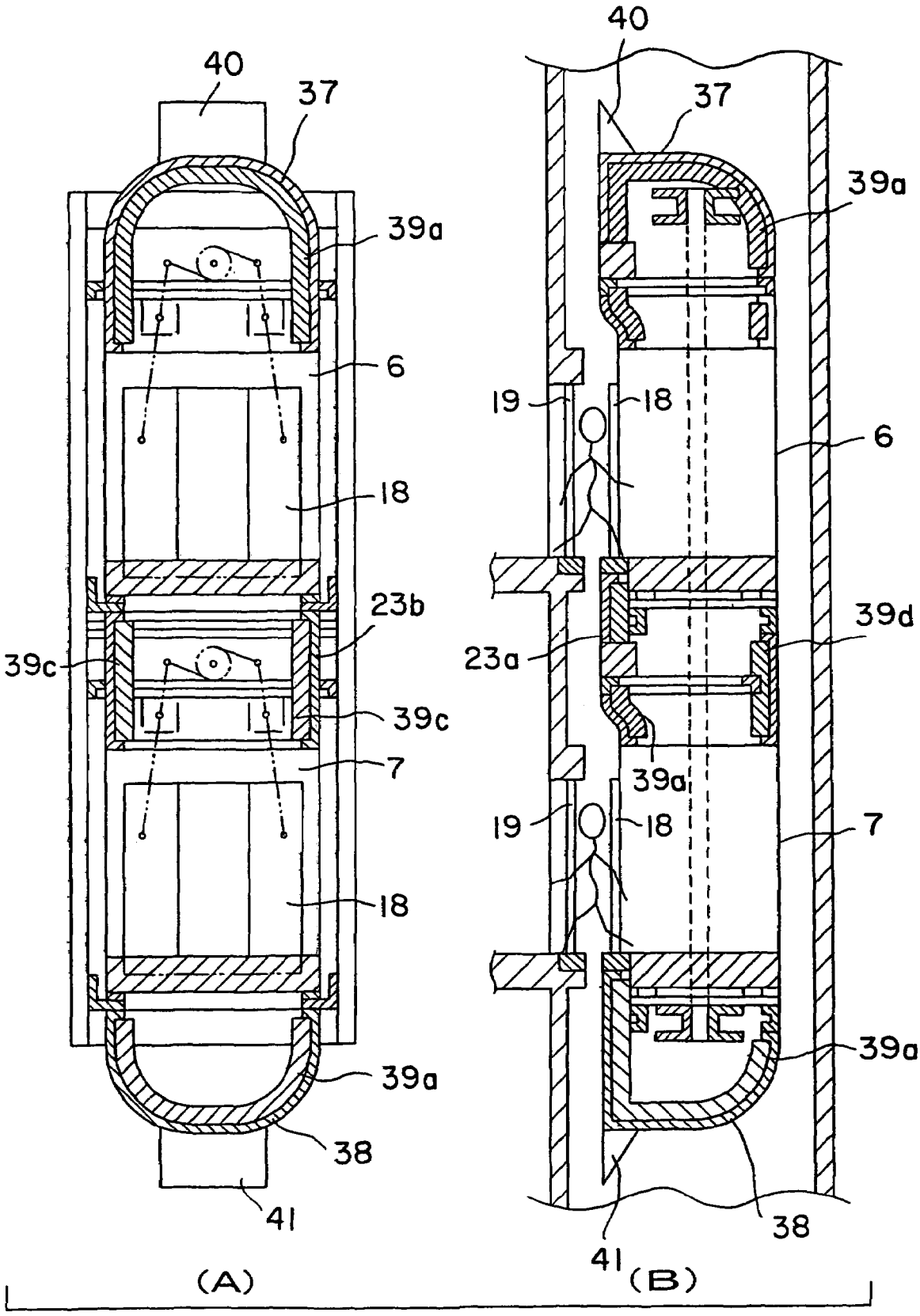
FIGS. 7A and 7B are schematic drawings showing a double deck elevator of another embodiment of the present invention.

In an embodiment of the double deck elevator shown in FIGS. 7A and 7B, a capsule type upper and lower air-guiding members 37, 38 are arranged-above the upper cage 6 and below the lower cage 7 respectively to guide an airflow into the clearances between inner walls of the hoistway 1 and outer side surfaces of the upper and lower cages 6, 7.

Also vibroisolating and noise absorbing materials 39*a*, 39*b*, 39*c* and 39*d* are attached to inner surfaces of the capsule type air-guiding device 37, 38 and covers 23*a*, 23*b* and 23*c*.

Furthermore, air-guiding cones 40, 41 which have triangular cross section for guiding the airflow flowing along the outer surfaces of the capsule type upper and lower air-guiding members 37, 38 are arranged above the upper air-guiding member 37 and below the lower wind-guiding device 38 respectively.

In this embodiment, since the capsule type air-guiding member 37, 38, the upper cage 6 and the lower cage 7 form a smooth streamline shape, airflow flow smoothly along the outer surfaces of the same and then air turbulence caused by the cages 6, 7 is reduced.

Also, since the vibroisolating and noise absorbing materials 39*a*, 39*b*, 39*c* and 39*d* are provided, the vibration of the air-guiding member 37, 38 and covers 23*a*, 23*b* and 23*c* is reduced, also noise insulation is achieved.

Furthermore, since the airflow guiding cones 40, 41 are provided, the airflow flowing along the outer surface of the air-guiding member 37. 38 is guided and flow further smoothly, the air resistance-of the cages 6, 7 is reduced.

Figure 8:
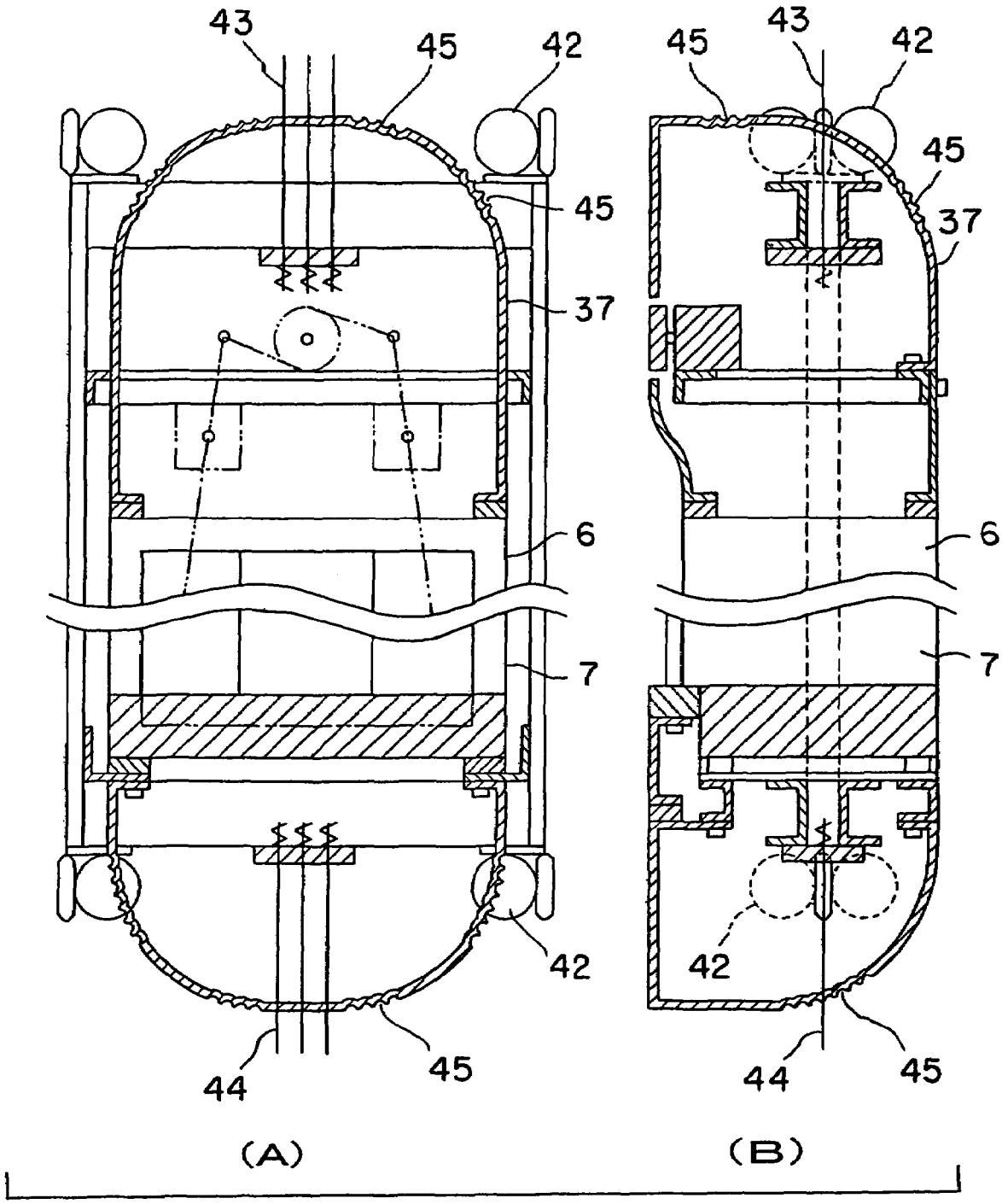
FIGS. 8A and 8B are-schematic drawings showing a double deck elevator of another embodiment of the present invention.

In an embodiment of the double deck elevator shown in FIGS. 8A and 8B, uneven concave serrations 6, 7 are provided on. the outer surface of the capsule type air-guiding device 37, 38 in the periphery of the guide rollers 42, main rope 43 and compensation rope 44.

By this arrangement, the generation of the air turbulence is reduced by the uneven concave serrations 6, 7, and accordingly the noise reduction is achieved. In addition, it is possible to use uneven convex serrations to obtain the same effects.

Figure 9:
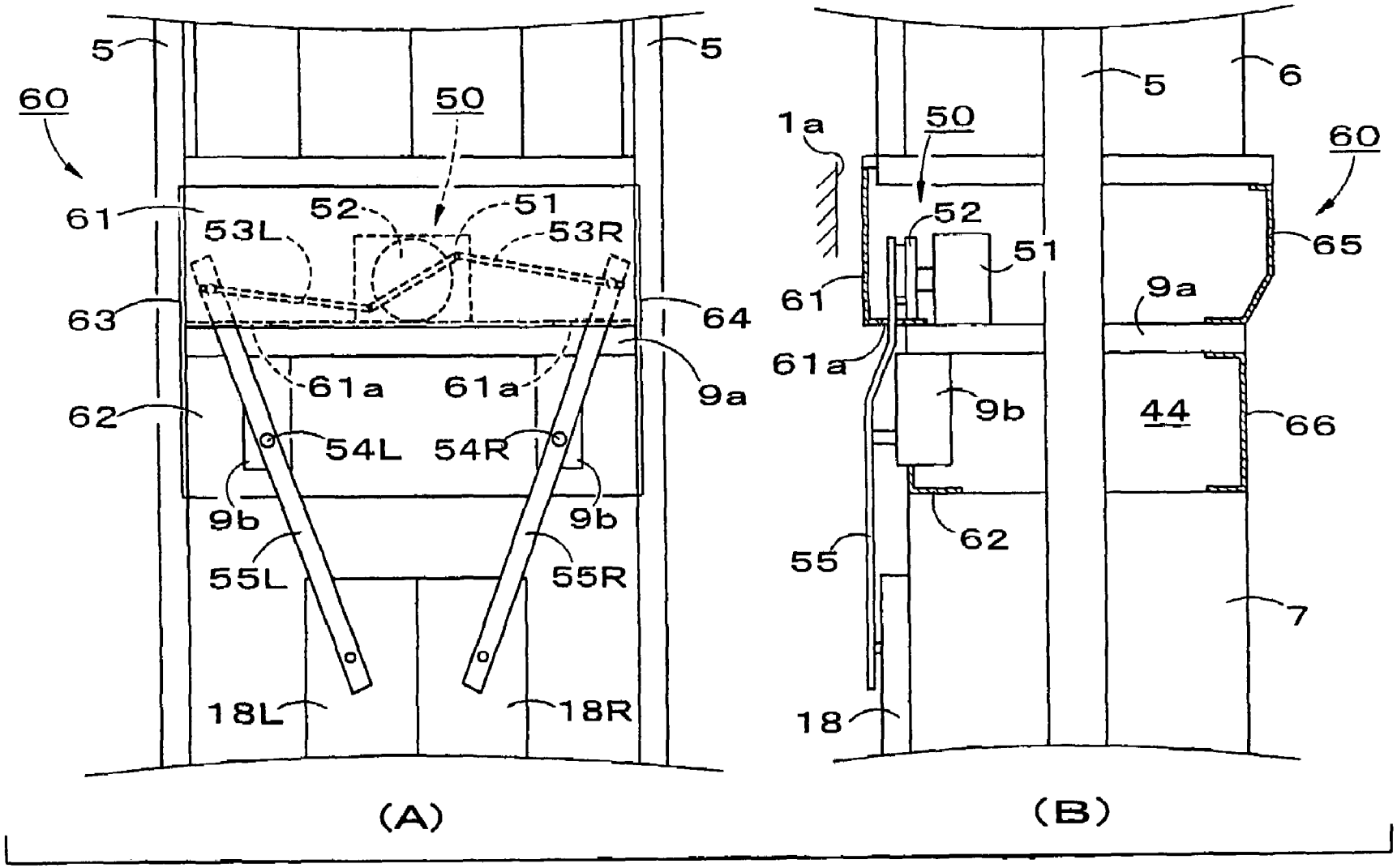
FIGS. 9A and 9B are enlarged schematic front and side elevation views showing a double deck elevator of another embodiment of the present invention.

In an embodiment of the double deck elevator shown in FIGS. 9A and 9B, cage door 18 provided on the lower cage7 is opened and closed by a door driving unit 50 mounted on the horizontal beam 9*a* of the cage frame 5.

The door-driving unit 50 comprises a rotating disc 52 driven by a driving motor 51, and a pair of connecting links 53L, 53R are pivotally connected to the rotating disc 52 at one ends thereof respectively. The other ends of the connecting links 53L, 53R are connected to the upper ends of door links 55L, 55R respectively. The door links 55L, 55R are pivotally supported on the supporting member 9*b* respectively by means of pivot shafts 54L and 54R provided on the respective support member 9*b* of the cage frame 5. Lower ends of the door links 55L, 55R are pivotally connected to the cage doors 18L, 18R respectively. By this arrangement, the cage doors 18L, 18R are opened and closed by the driving motor 51.

The space 44 between the upper and lower cages 6, 7 is covered by a cover 60 that guides the airflow flowing along the space 44. The cover 60 comprises a pair of upper and lower door-side covers 61, 62, a pair of right and left side covers 63, 64 and a pair of upper and lower backside covers 65, 66.

The upper door-side cover 61 is positioned closer to the door-side inner wall 1*a* of the hoistway 1 than the door driving unit 50 and covers the door driving unit 50. And, the upper door-side cover 61 is provided with a pair of slits 61*a*, through which door links 55L, 55R are inserted respectively.

By this arrangement, the upper door-side cover 61 fully covers the door driving unit 50 and the top portions of the door links 55L, 55R without preventing the movement of door links 55L, 55R.

Since the cover 60 guides the airflow, the airflow cannot enter the space 44 and cannot come into collisions with various unevenness existing in the space 44, such as the door-driving unit 50, and do not generate air turbulence. As a result, air turbulence noise can be effectively reduced when the cages 6, 7 move vertically in the hoistway 1 at a high speed, and quietness and comfortableness in the cages 6, 7 can be improved.

At the same time, since the space 44 is separated from the inner space of the hoistway 1 by the cover 60, noise in the hoistway 1 cannot enter the cages 6, 7 through the space 44, then quietness and comfortableness in the cages 6, 7 is further improved.

And, since the cover 60 guides the airflow into clearances between the inner walls of the hoistway 1 and the outer side surfaces of the cages 6, 7, the air resistance of the cages 6, 7 is reduced and the moving speed of the cages 6, 7 can be increased.

Figure 10:
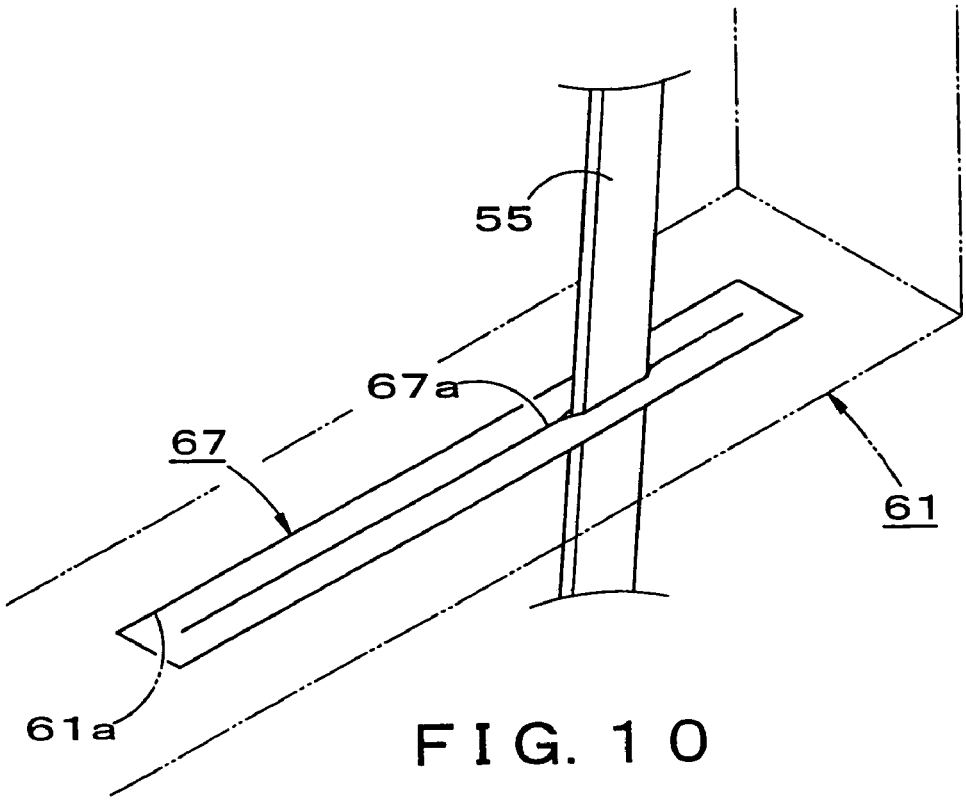
FIG. 10 is a perspective view showing a slit-closing member used with the covers shown in FIGS. 9A and 9B.

In an embodiment of the double deck elevator shown in FIG. 10, there is provided a slit-closing member 67 made of an elastic material, such as a rubber film or a thin plastic film, which closes a clearance between the periphery of the slit 61*a* and the door link 55. This slit-closing member 67 has a slit 67*a* extending along the moving direction of the door link 55, through which the door link 55 is inserted, and allows the displacement of the door link 55 by its elastic deformation caused by contact with the door link 55. By this arrangement, the airflow cannot enter or exit from the space 44 through the slit 61*a*, and do not generate air turbulence noise. As a result, quietness and comfortableness in the cages 6, 7 are improved.

Figure 11:
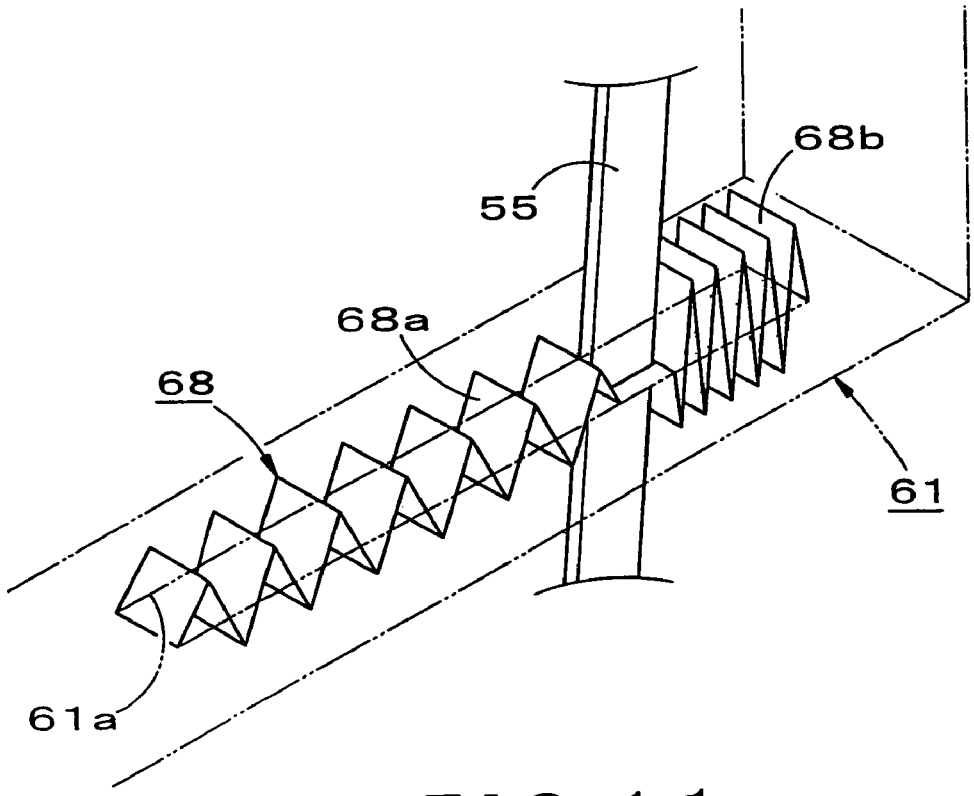
FIG. 11 is a perspective view showing a slit-closing member of another embodiment.

In an embodiment of the double deck elevator shown in FIG. 11, there is provided a bellows type slit-closing member 68 made of an elastic material, such as a rubber film or a thin plastic film. This bellows type slit-closing member 68 comprises a pair of bellows 68*a*, 68*b* that expand and contract along the moving direction of the door link 55 and closes the clearance between the periphery of the slit 61*a* and the door-link 55. This slit-closing member 68 has an aperture through which the door link 55 is inserted, and allows the displacement of the door link 55 by its elastic deformation caused by contact with the door link 55. By this arrangement, airflow cannot enter or exit the space 44 through the slit 61*a*, and do not generate air turbulence noise. As a result, quietness and comfortableness in the cages 6, 7 are improved.

Figure 12:
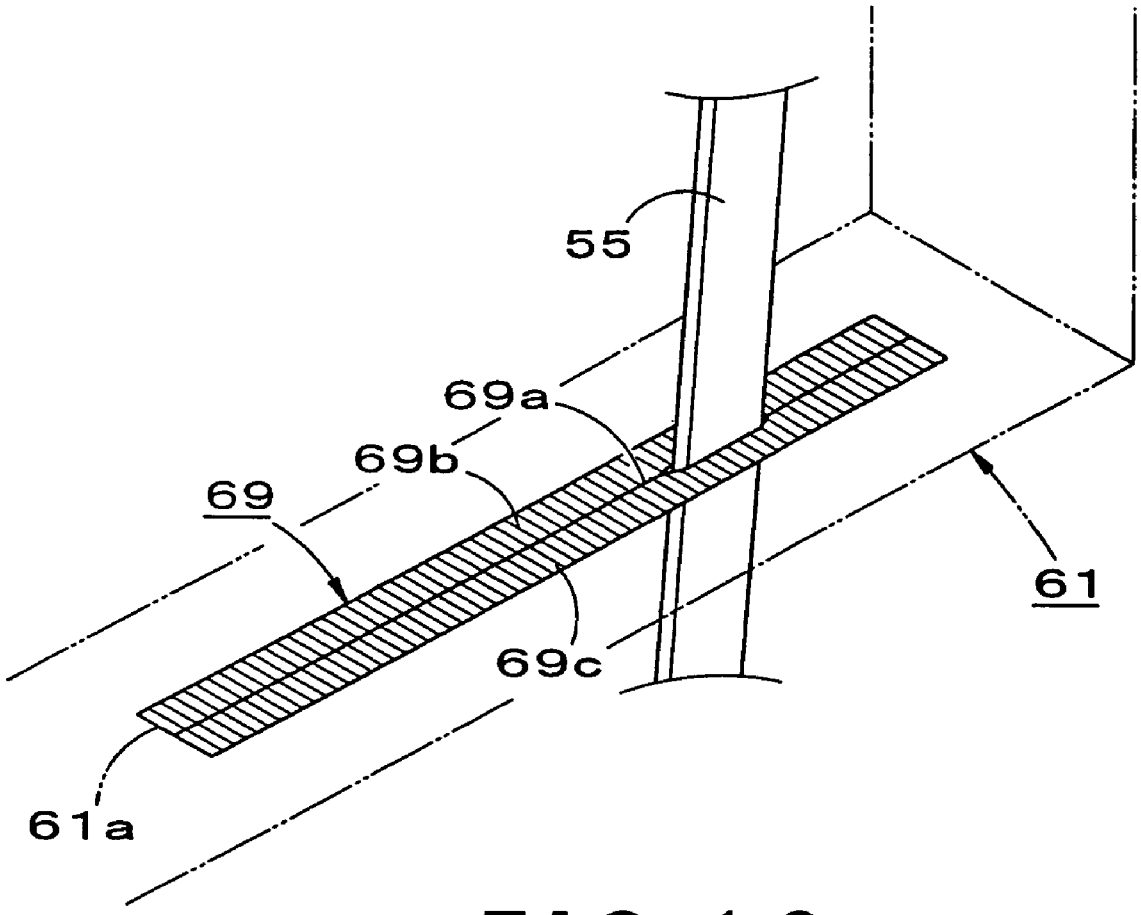
FIG. 12 is a perspective view showing a slit-closing member of another embodiment.

In an embodiment of the double deck elevator shown in FIG. 12, there is provided a brush type slit-closing member 69 made of an elastic material, such as a plastic bristles, which closes a clearance between the periphery of the slit 61*a* and the door link 55. This brush type slit-closing member 67 comprises a pair of front and rear brushes 69*b*, 69*c* facing each other to formal slit 69*a* extending along moving direction of the door link 55. The slit 69*a* allows the displacement of the door link 55 by its elastic deformation caused by the contact with the door link 55. By this arrangement, the airflow cannot enter or exit from the space 44 through the slit 61*a*, and do not generate air turbulence noise. As a result, the quietness and the comfortableness in the cages 6, 7 are increased.

Figure 13:
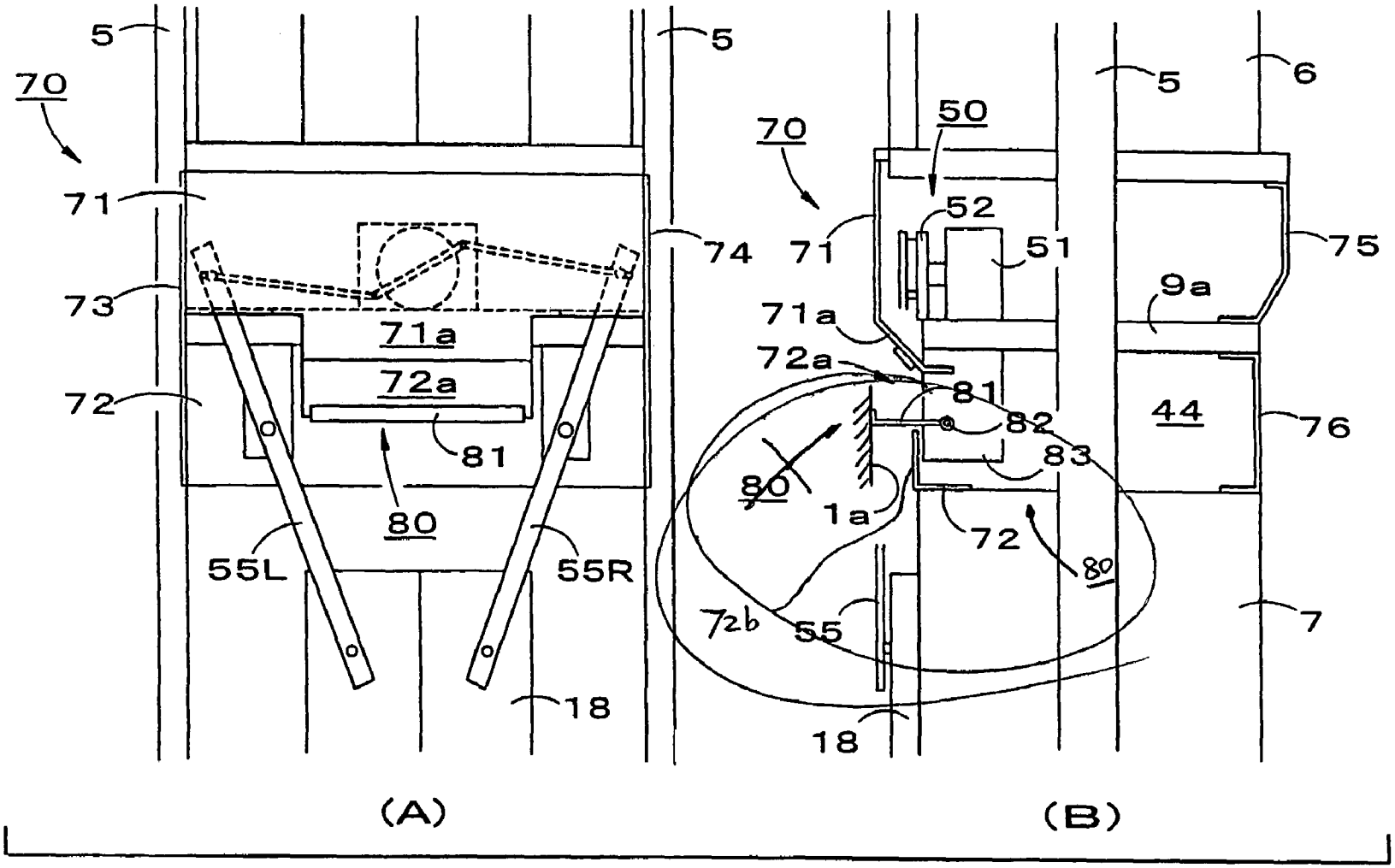
FIGS. 13A and 13B are enlarged schematic front and side views elevation views showing a double deck elevator of another embodiment of the present invention.
Figure 14:
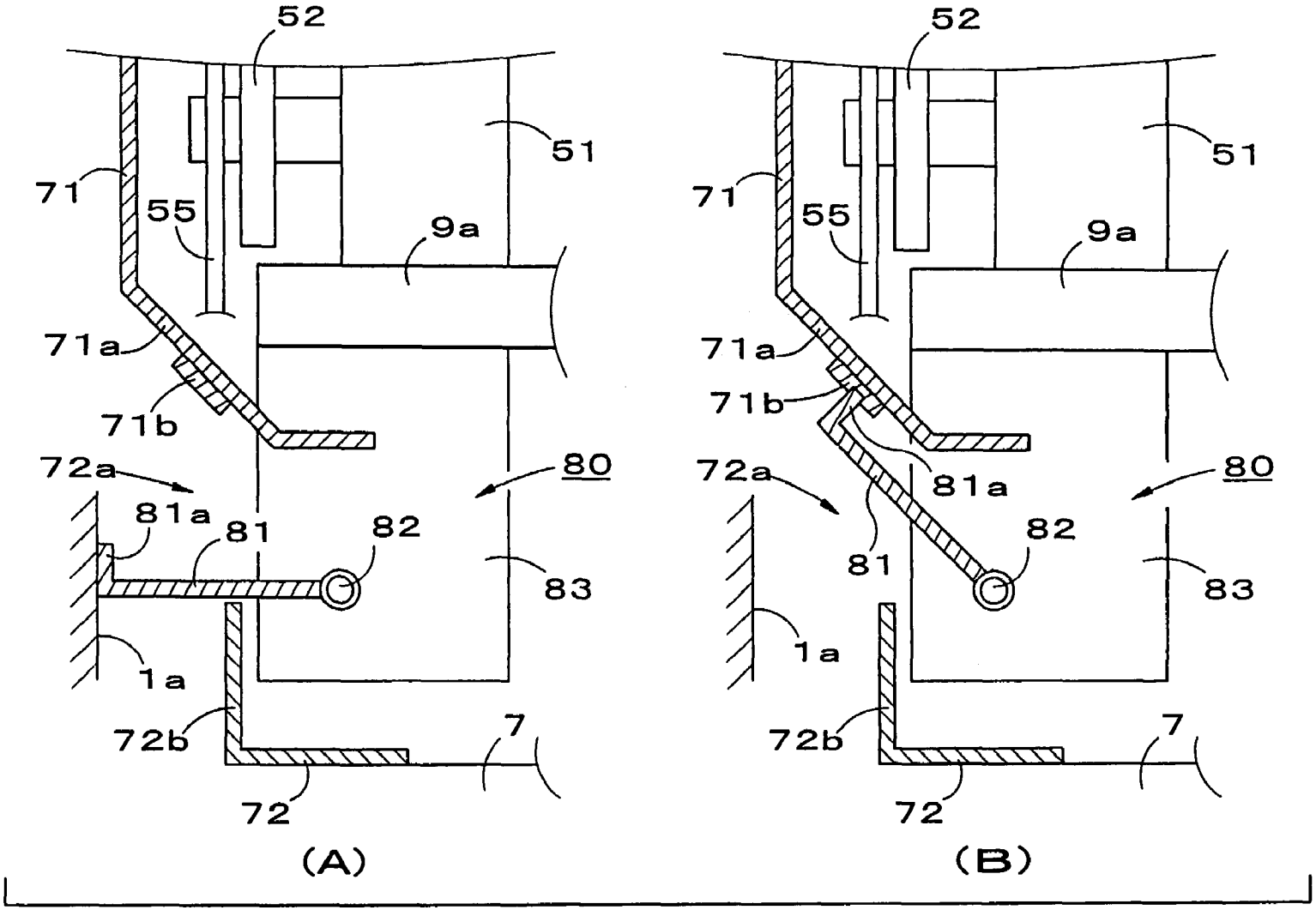
FIGS. 14A and 14B are enlarged sectional side elevation views of the clearance-closing member shown in FIGS. 13A and 13B.

In an embodiment of the double deck elevator shown in FIGS. 13 and 14, the space 44 between the upper and lower cages 6, 7 is covered by cover 70, which comprises a pair of upper and lower door-side covers 71,72, a pair of lateral-sides covers 73,74 and a pair of backside covers 75, 76.

In the space 44, there is provided a falling matter catching means 80 for catching the falling matter, such as dirt or water, falling from the clearance between the door-side inner wall 1*a* of the hoistway 1 and the upper cage 6.

The upper door-side cover 71 has a inclined lower portion 71*a* entering the space 44 at its lateral mid section, which absorb the horizontal position difference between the upper and lower cages 6, 7 so that the-airflow can smoothly flow along the door-side surface of the upper and lower cages 6, 7.

The lower door-side cover 72 has an opening 72*a* through which a falling matter catching plate 81 of the device 80 approaches and moves apart from the door-side inner wall 1*a* of the hoistway 1. Also, the lower door-side cover 72 has a vertical wall 42*a* positioned closer to the door-side inner wall 1*a* of the hoistway 1 than the falling matter catching device 80, to prevent the air flow from contacting the falling matter catching device 80 and generating air turbulence noise.

By this arrangement, even when a falling matter catching device 80 is provided in the space 44, the door-side cover 71, 72 guide the airflow to reduce air turbulence noise and improve quietness and comfortableness in the upper and lower cages 6, 7.

The falling matter catching device 80 comprises the catching plate 81 mentioned above which approaches and leave the door-side inner-wall 1*a* of the hoistway 1, and a driving motor 3 which swings the catching plate 81 around the horizontal swinging axis 82.

When the upper and lower cages 6, 7 stop vertical moving in the hoistway 1, the-catching plate 81 approaches the door-side inner wall 1*a* of the hoistway 1 and extends horizontally as shown in FIGS. 13B and 14A so that its free end 81*a* contacts the door-side inner wall 1*a*. And this catching plate 81 receives the falling matter to prevent the falling matter from dropping toward the passengers entering and exiting the lower cage 7.

Before the upper and lower cages 6, 7 start vertical moving, the catching plate 81 moves apart from the door-side inner wall la so as not to prevent vertical movement of the cages 6,7. Also, this catching plate 81 inclines parallel to the inclined lower portion 71*a* of the upper door-side cover 71 as shown in FIG. 14B, so that the airflow flows smoothly along the outer surface of the upper and lower door-side cover 71, 72.

While, the inclined lower portion 71*a* of the upper door-side cover 71 serves as a stopper for limiting the moving stroke of the catching plate 81. As a result, it is not necessary to provide the falling matter catching device 80 with the stopper.

Furthermore, a horizontally extending clearance-closing member 71*b* made of sponge rubber strip is provided on the inclined lower portion 71*a*, and the free end 81*a* of the catching plate 81 strongly presses this clearance-closing member 71*b* against the inclined lower portion 71*a*.

In this manner, the clearance between the upper door-side cover 71 and the falling matter caching plate 81 is surely closed, and the airflow can not enter the space 44 through the clearance and do not generate air turbulence noise.

In an embodiment of the double deck elevator shown in FIGS. 15A, 15B, there is provided a clearance-closing means 90 for closing the clearance between the vertical wall 72*b* of the lower door-side cover 72 and the falling matter catching plate 81.

The clearance-closing member 90 comprises a slide plate 61 slidably held by the vertical wall 72*b* of the lower door-side cover 72, and a connecting link 92 which is pivotably connected to the lower surface of the falling matter catching plate 81 at its one end via a connecting portion 81*b* and to the top end of the sliding plate 91 at its another end via connecting portion 91*a*.

The sliding plate 91 slides downwardly due to the weight thereof when the catching plate 81 approaches the door-side inner wall 1*a* of the hoistway 1 as shown in FIG. 15A. On the contrary, the sliding plate 91 slides upwardly pulled by the connecting link 92 when the catching plate 81 moves apart from the door-side inner wall 1*a* of the hoistway 1 as shown in FIG. 15B.

By this arrangement, since the slide plate 91 always closes the clearance between the vertical wall 72*b* of the lower door-side cover 72 and the catching plate 81 without disturbing the movement of the catching plate 81, the airflow flows smoothly along the door-side covers 71, 72, and does not enter the space 44 through the clearance and does not generate the air turbulence noise.

Figure 16:
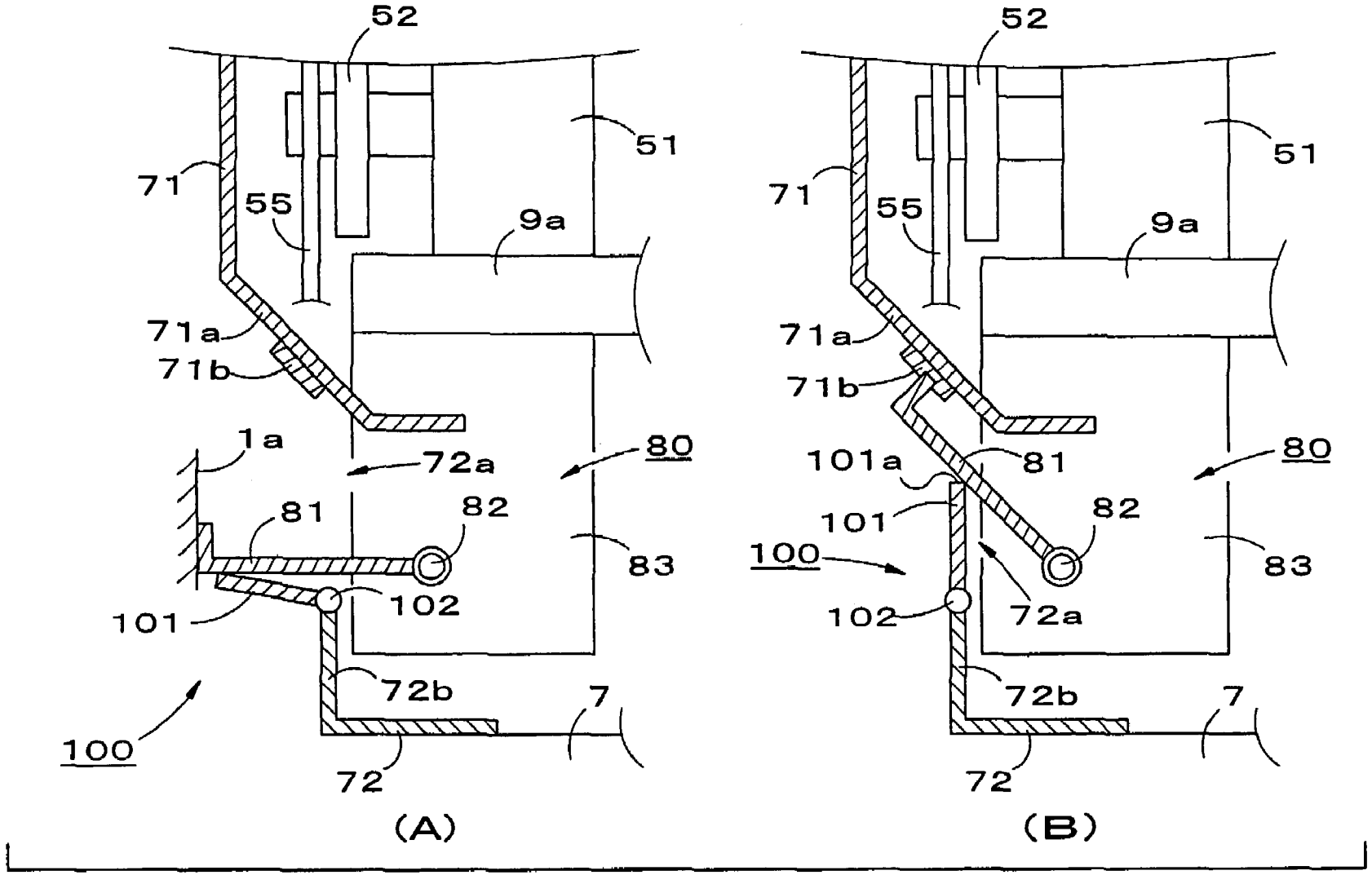
FIGS. 16A and 16B are enlarged sectional side elevation views of the clearance-closing member of another embodiment.

In an embodiment of the double deck elevator shown in FIGS. 16A, 16B, there is provided a clearance-closing means 100 for closing the clearance between the vertical wall 72*b* of the lower door-side cover 72 and the falling matter catching plate 81.

The clearance-closing-means 100 comprises a pivot plate 101 pivotably connected to the vertical wall 72*b* of the lower door-side cover 72 at its lower end via a horizontally extending axis 102. And this pivot plate 101 is always biased to rotate around the axis 102 by biasing means (not shown) such as a torsion bar, so that the upper end 101*a* of the pivot plate 101 always contacts the lower surface of the catching plate 81.

When the catching plate 81 approaches the door-side inner wall 1*a* of the hoistway 1, the pivoting plate 101 counterclockwisely pivots around the horizontal axis 102 opposing to the biasing forces and inclines toward the door-side inner wall 1*a* as shown in FIG. 16A. On the contrary, when the catching plate 81 moves apart from the inner wall 1*a* of the hoistway 1, the pivot plate pivots clockwisely biased by the biasing means as shown in FIG. 16B.

By this arrangement, since the pivot plate 101 always closes the clearance between the vertical wall 72*b* of the lower door-side cover 72 and the catching plate 81 without disturbing the movement of the catching plate 81, the airflow flows smoothly along the door-side covers 71, 72, and does not enter the space 44 through the clearance and does not generate the air turbulence noise.

Figure 15:
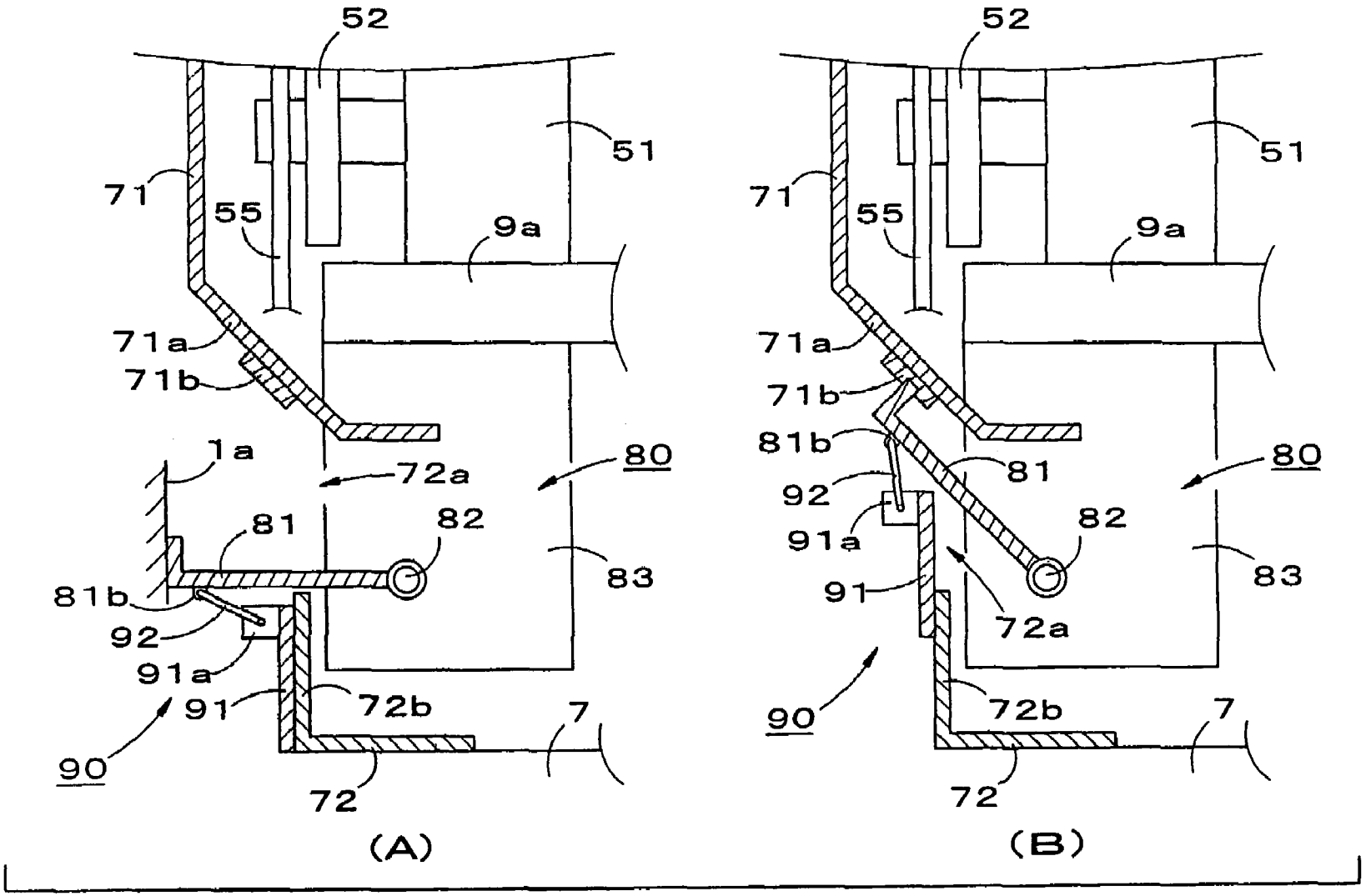
FIGS. 15A and 15B are enlarged sectional side elevation views of the clearance-closing member of another embodiment.

In addition, it is possible to eliminate the biasing means, and to connect the top edge 101*a* of the pivot plate 101 via a connecting link (as shown in FIG. 15) to the catching plate 81.

Figure 17:
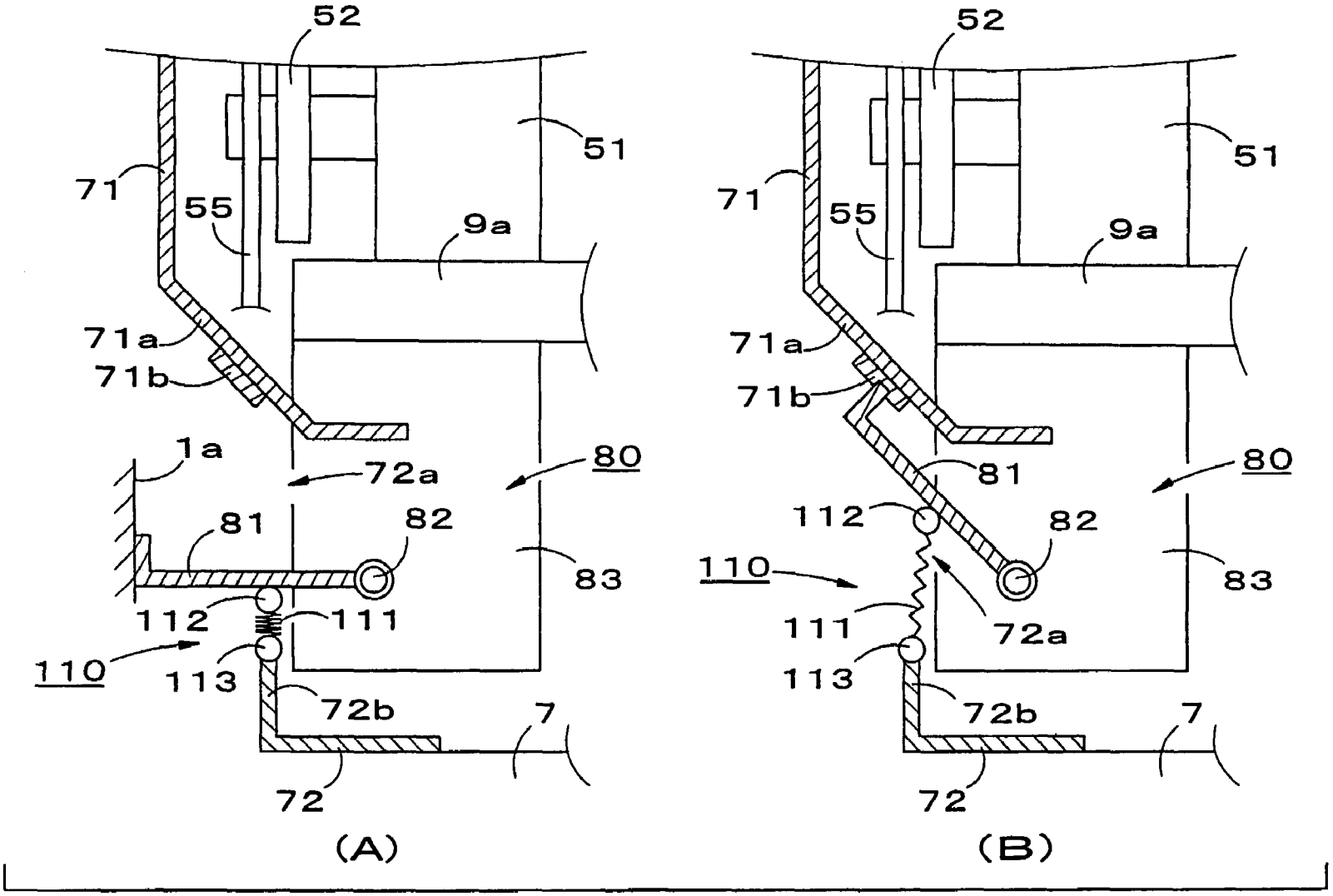
FIGS. 17A and 17B are enlarged sectional side elevation views of the clearance-closing member of another embodiment.

In an embodiment of the double deck elevator shown in FIGS. 17A, 17B, there is provided a clearance-closing means 110 for closing the clearance between the vertical wall 72*b* of the lower door-side cover 72 and the falling matter catching plate 81.

The clearance-closing means 110 comprises a bellows 111 made of an elastic material such as a rubber plate or plastic film, which is connected to the falling matter catching plate 81 via connecting portion 112 at upper end thereof, and is connected to the lower door-side cover 72 via connecting portion 113 at lower end thereof.

When the catching plate 81 approaches the door-side inner wall 1*a* of the hoistway 1, the bellows 111 contracts as shown in FIG. 17A. On the contrary, when the catching plate 81 moves apart from the inner wall 1*a* of the hoistway 1, the bellows expands as shown in FIG. 17B.

By this arrangement, since the bellows 111 always closes the clearance between the vertical wall 72*b* of the lower door-side cover 72 and the catching plate 81 without disturbing the movement of the catching plate 81, the airflow flows smoothly along the door-side covers 71, 72, and does not enter the space 44 through the clearance and does not generate the air turbulence noise. In addition, instead of the bellows 111, it is possible to use straight elastic material that is expandable and contractible such as thin rubber film.

Figure 18:
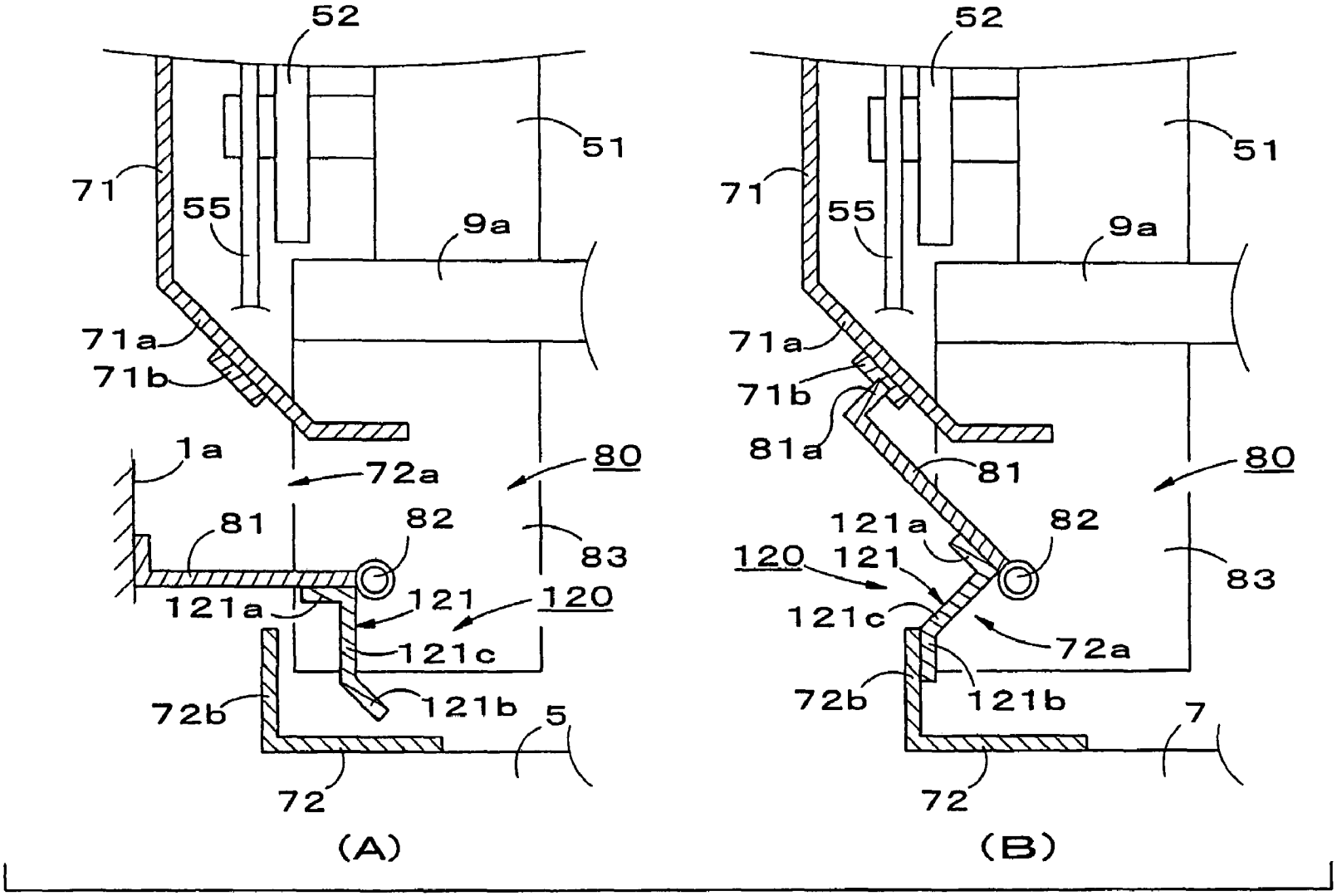
FIGS. 18A and 18B are enlarged side sectional elevations of an opening closing member.

In an embodiment of the double deck elevator shown in FIGS. 18A, 18B, there is provided a clearance-closing means 120 for closing the clearance between the vertical wall 72*b* of the lower door-side cover 72 and the falling matter catching plate 81.

The clearance-closing means 120 comprises a closing plate 121, which is fixed to the lower surface of the catching plate 81 at its base end 121*a* and moves together with the catching plat 81.

When the catching plate 81 approaches the door-side inner wall 1*a* of the hoistway 1, the free end 121*b* of the closing plate 121 is in the space 44 apart from the inner surface of the vertical wall 72*b* of the lower door-side cover 72 as shown in FIG. 18A. On the contrary, when the catching plate 81 moves apart from the inner wall 1*a* of the hoistway 1 and its free end 81*a* contacts the inclined lower portion 71*a* of the upper door-side cover 71 via the clearance-closing member 71*b*, the free end 121*b* of the closing plate 121 rests on the inner surface of the vertical wall 72*b* and closes the clearance between the vertical wall 72*b* and the falling matter catching plate 81.

By this arrangement, since the closing plate 121 closes the clearance between the vertical wall 72*b* and the catching plate 81 without disturbing the movement of the catching plate 81, the airflow flows smoothly along the door-side covers 71, 72, and does not enter the space 44 through the clearance and does not generate the air turbulence noise.

Figure 19:
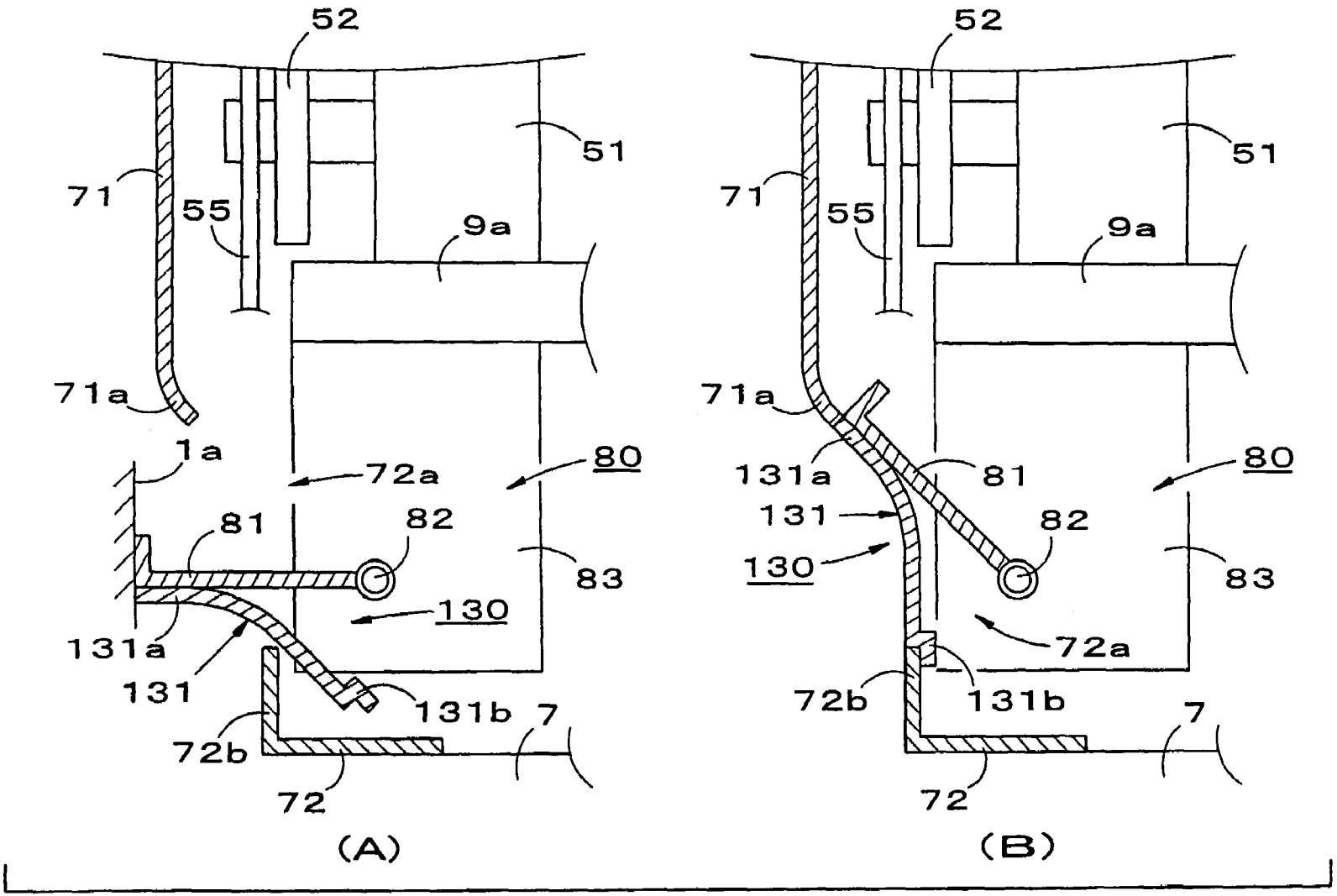
FIGS. 19A and 19B are enlarged side sectional elevations of an opening closing member of another embodiment

In an embodiment of the double deck elevator shown in FIGS. 19A, 19B, there is provided an opening closing means 130 for closing the opening 72*a* of the lower door-side cover 72.

The opening closing means 130 comprises a closing plate 133, which is fixed to the lower surface of the catching plate 81 at its one end 131*a* and moves together with the catching plat 81.

When the catching plate 81 approaches the door-side inner wall 1*a* of the hoistway 1, the free end 131*b* of the closing plate 131 is in the space 44 apart from the inner surface of the vertical wall 72*b* of the lower door-side cover 72 as shown in FIG. 19A. On the contrary, when the catching plate 81 moves apart from the inner wall 1*a* of the hoistway 1, the free end 131*b* of the closing plate 131 rests on the inner surface of the vertical wall 72*b* and stops the movement of the catching plate 81, at the same time, the closing plate entirely closes the opening 72*a* of the lower door-side cover 72 as shown in FIG. 19B.

Furthermore, the closing plate 131 has an outer surface 131*c* which is connected to those of the door-side covers 72 without any steps, when the closing plate 131 closes the opening 72*a*.

By this arrangement, since the closing plate 131 closes the opening 72*a* without disturbing the movement of the catching plate 81, the airflow flows smoothly along the door-side covers 71, 72, and does not enter the space 44 through the opening 72*a* and does not generate the air turbulence noise.

Figure 20:
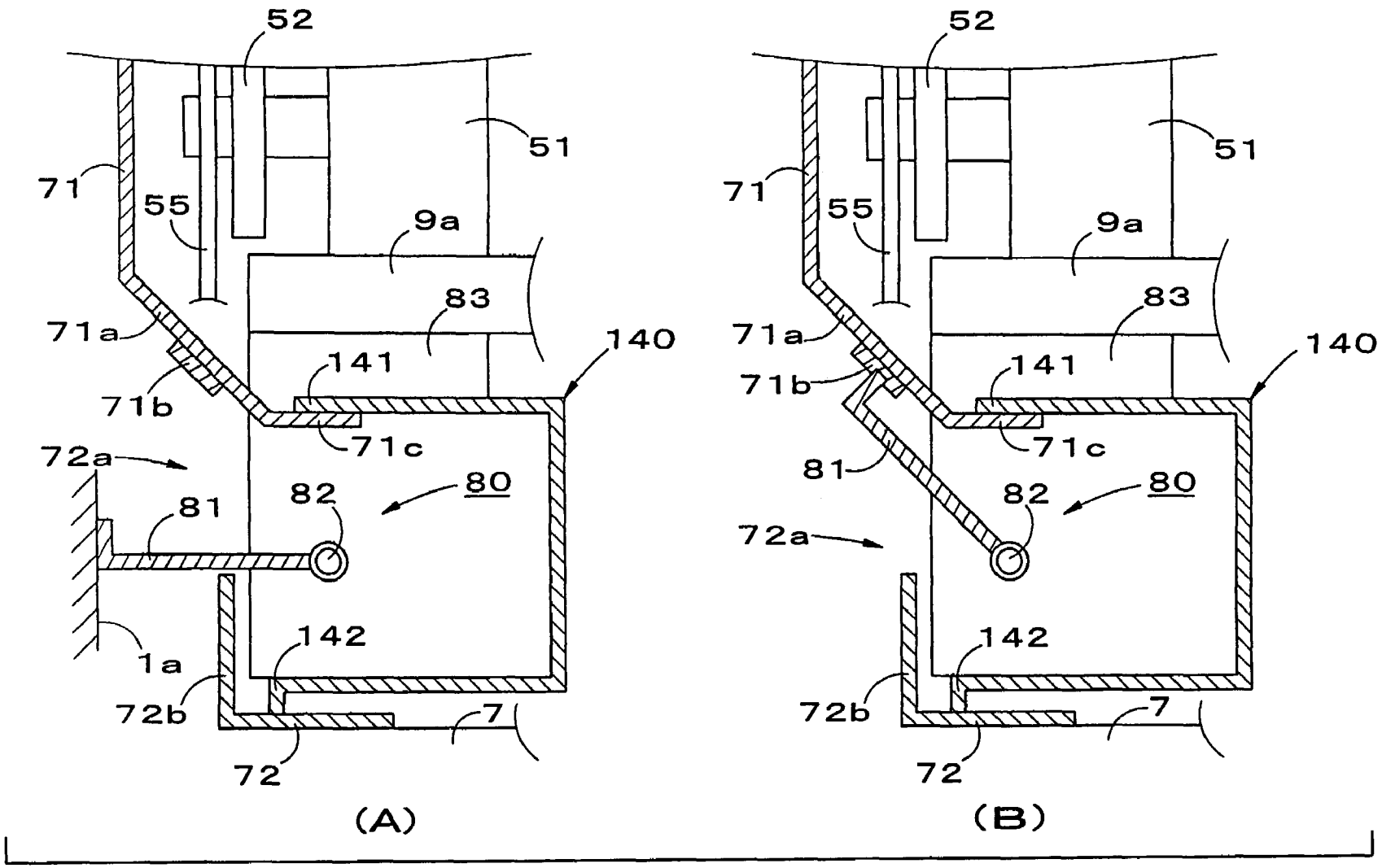
FIGS. 20A and 20B are enlarged side sectional elevations of a noise insulating member.

In an embodiment of the double deck elevator shown in FIGS. 20A, 20B, there is provided a box like noise-insulating member 140 for insulating the noise entering the space 44 between the upper and lower cages 6, 7 from the opening 72*a* of the lower door-side cover 72.

The noise-insulating member 140 is open toward the opening 72*a*, and is connected to the lower end 71*c* of the upper door-side cover 71 at its front upper edge 141, and is further connected to the lower door-side cover 72 at its front lower edge 142. It is preferable to attach the noise-absorbing material, such as glass fiber, to the inner surface of the noise-insulating member 140.

By this arrangement, since the noise entering from the opening 72*a* is insulated and absorbed in the noise-insulating member 140 and cannot reach the upper and lower cages 6,7, without disturbing the movement of the falling matter catching plate 81, quietness and comfortableness in the upper and lower cages 6, 7 is improved.

Figure 21:
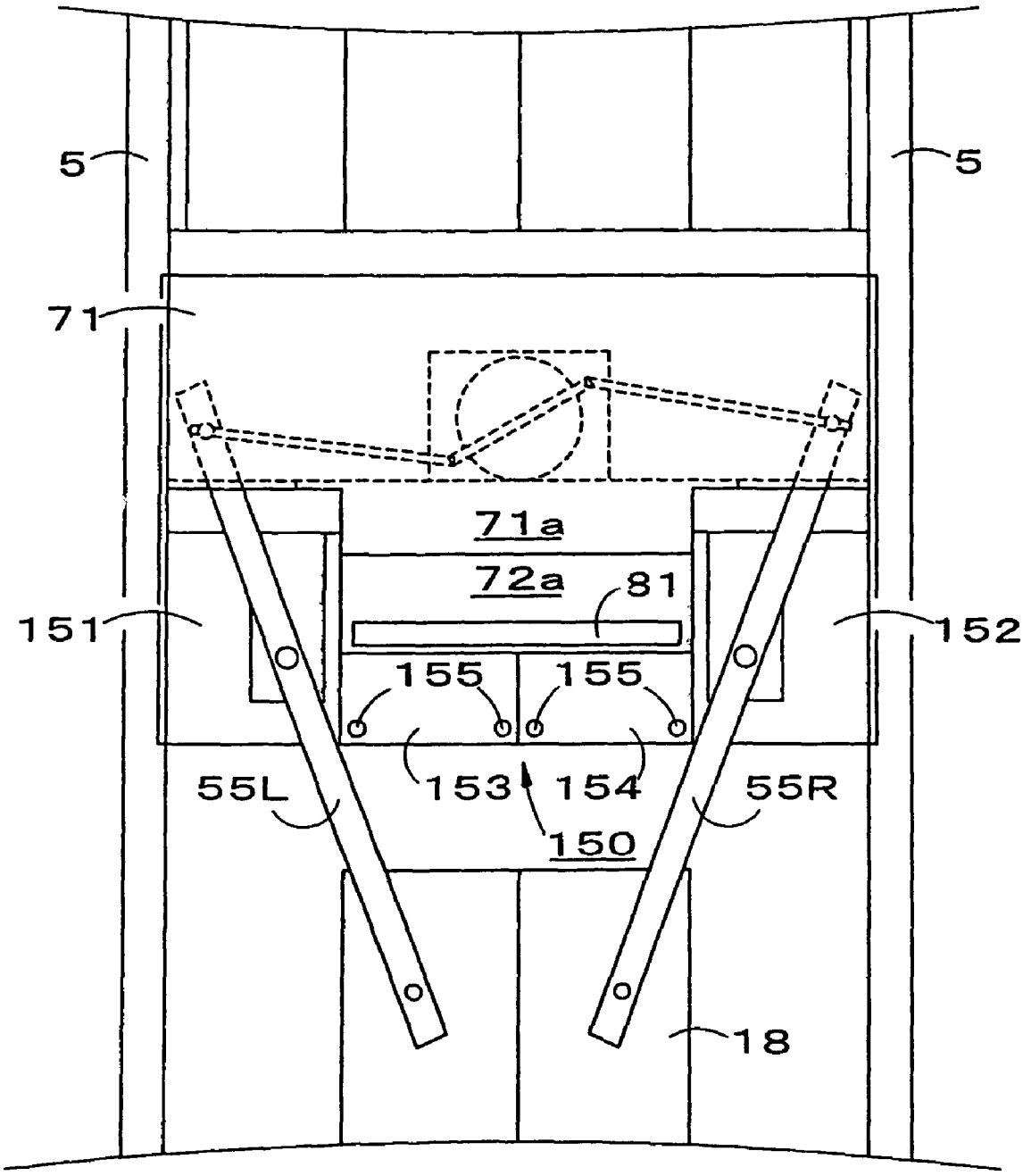
FIG. 21 is an enlarged schematic front view showing a double deck elevator of another embodiment of the present invention.
Figure 22:
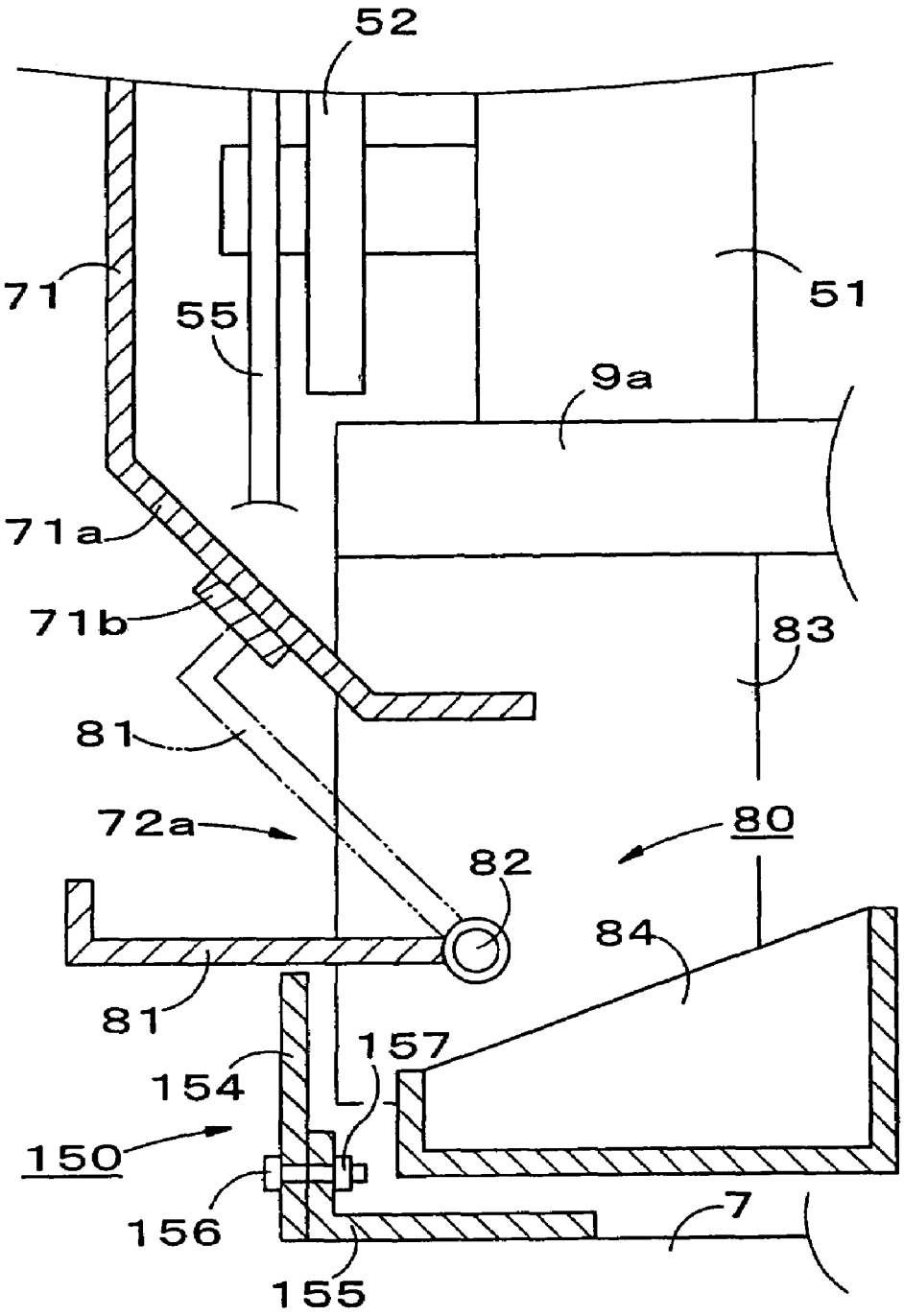
FIG. 22 is an enlarged sectional side elevation view of the covers shown in FIG. 21.
Figure 23:
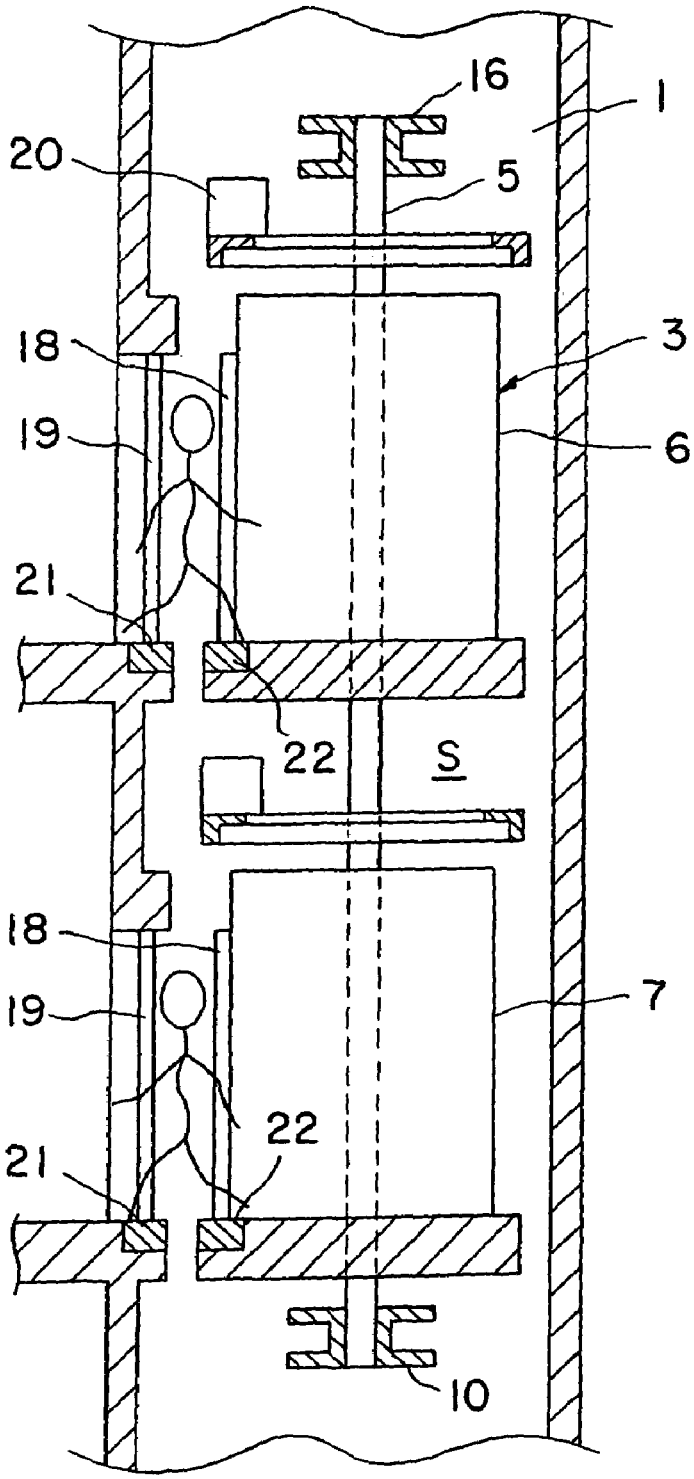
FIG. 23 PRIOR ART
FIG. 23 is a schematic side sectional elevation view showing a double-deck elevator of the prior art.
Figure 24:
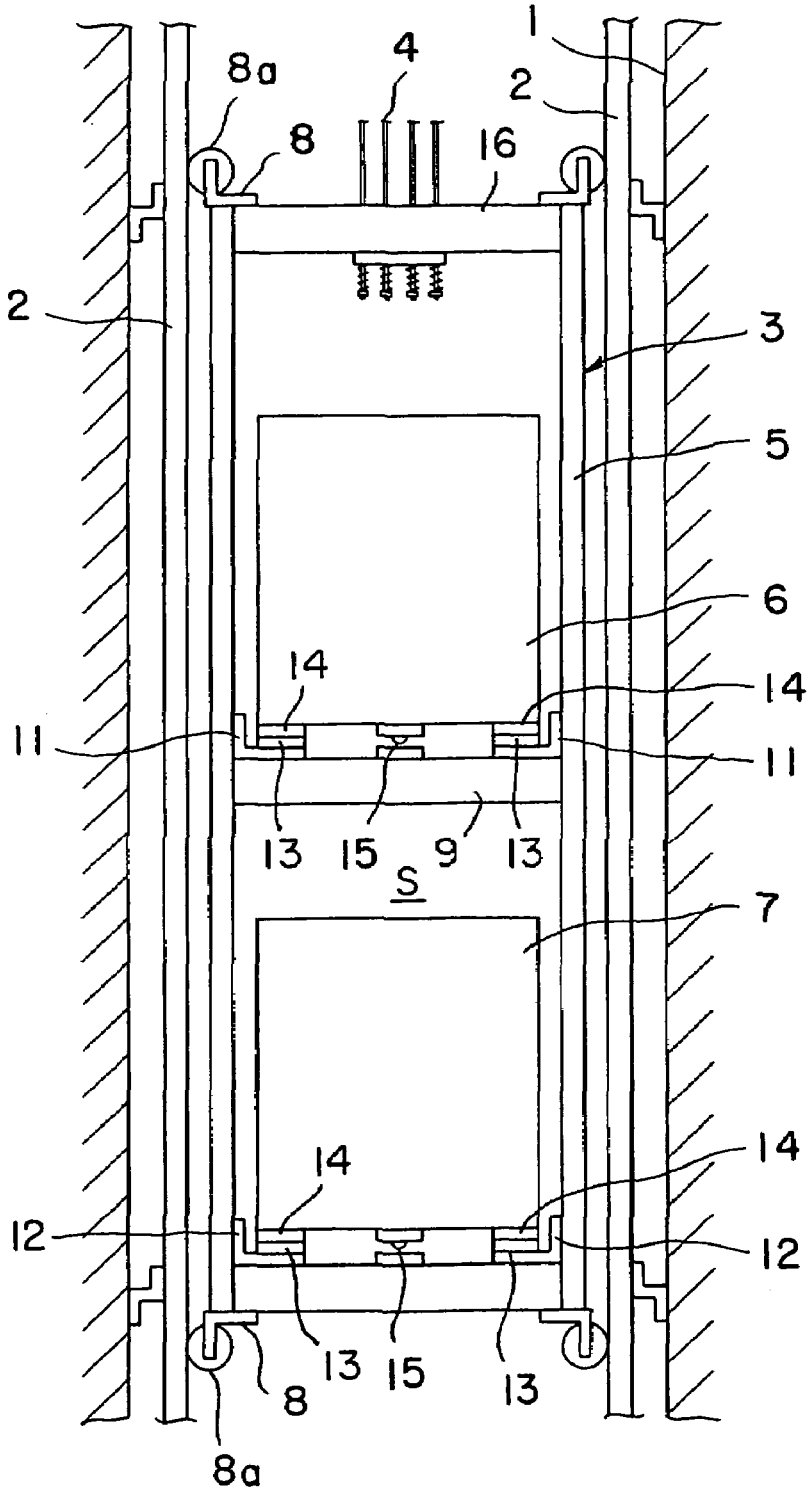
FIG. 24 PRIOR ART
FIG. 24 is a schematic front elevation view showing another double-deck elevator of the prior art.
Figure 25:
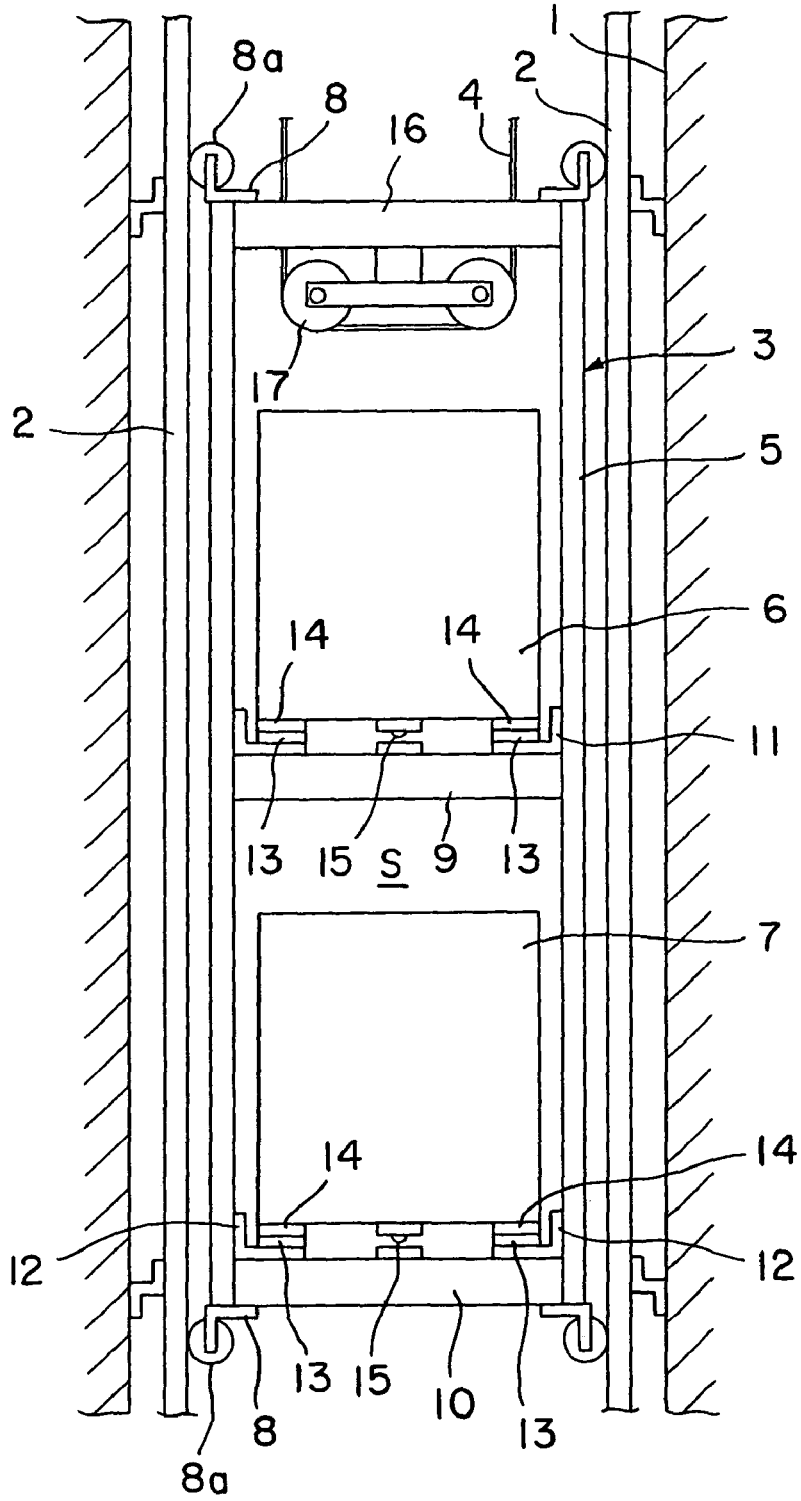
FIG. 25 PRIOR ART
FIG. 25 is a schematic front elevation view showing another double deck elevator of the prior art.

In an embodiment of the double deck elevator shown in FIGS. 21 and 22, there is provided a falling matter storing box 84 for storing the falling matters caught by the falling matter catching plate 81. That is, the falling matters caught by the catching plate 81 is guided to drop into the storing box 84 when the catching plate 81 moves apart from the door-side inner wall 1*a* and inclines as shown in FIG. 23 by phantom lines.

Therefore, it is necessary to remove the falling matters stored in the storing box 84, when the maintenance or inspection of the double deck elevators is performed. However, it is difficult to remove the falling matters stored in the storing box 84 in the above mentioned double deck elevator, due to the presence of the lower door-side cover 72.

For this reason, the lower door-side cover 150 in this embodiment is divided into four parts 151, 152, 153 and 154 as shown in FIG. 21. Especially, the parts 153, 154 facing the storing box 84 are smaller than the floor-side door openings respectively. In other words, the horizontal width of the parts 153, 154 is smaller than the horizontal width or the vertical height of the floor-side door opening, which is formed when the floor-side doors 19 open.

Furthermore, as shown in FIG. 22, the door parts 153, 154 are removably mounted to the bracket 155 fixed on the lower cage 7 by means of butter fly screws 156 and nuts 157 respectively.

Therefore, when the double deck elevator of this embodiment is inspected or maintained, the worker on the floor can easily remove the parts 153, 154 by manually loosening the butter fly screws 156 through the floor-side door opening and put them on the floor. After removing the parts 153, 154 from the lower cage 7, it is easy to access the store box 84 to remove the stored falling matters. Similarly, it is easy to mount the parts 153, 154 to the lower cage 7.

While the many preferred embodiments of the invention have been described, such description is for illustrative purpose only, and it is to be understood that changes and variations may be made without departing from the spirit or scope of the following claims.

What is claimed is:

1. A double-deck elevator comprising:

an upper cage and a lower cage for accommodating passengers and vertically movable together in a hoistway provided in a building;

covers positioned so as to cover a space between the upper cage and the lower cage at a doorside, two lateral sides, and a backside of the space; and a catching plate for catching objects dropped through a clearance between the doorside inner wall of the hoistway and the upper cage sill, wherein the covers and the cages are connected such that, at the point of connection, the outer surfaces of the covers and the cages are in the same plane, the doorside cover, which covers the doorside of the space, has a first portion extending downwardly from an end of an upper cage sill along a doorside inner wall of the hoistway, a second portion extending from a lower end of the first portion and curving into said space, and a third portion extending from a lower end of the second portion to a doorside end of a ceiling of the lower cage, said catching plate is capable of swinging about a horizontal axis between a first position in which a distal end thereof contacts the doorside inner wall of the hoistway and a second position in which the distal end retracts from the doorside inner wall, and said catching plate is disposed to open and close an opening provided at the second portion of the doorside cover.

2. The double-deck elevator according to claim 1, wherein said horizontal axis is disposed in the space at the inner side of the third portion of the doorside cover.

3. The double-deck elevator according to claim 1, wherein said catching plate in the second position and the doorside cover guide an air flow flowing along the doorside cover.

4. A double-deck elevator comprising:

an upper cage and a lower cage for accommodating passengers and vertically movable together in a hoistway provided in a building; and covers positioned so as to cover a space between the upper cage and the lower cage at a doorside, two lateral sides, and a backside of the space, wherein the covers and the cages are connected such that, at the point of connection, the outer surfaces of the covers and the cages are in the same plane, said upper cage and lower cage are supported on a cage frame by means of vibroisolating rubbers, and at least one end of the covers for covering the space is connected to at least one of the upper cage and the lower cage by means of an elastic member for absorbing a distance change between the upper cage and the lower cage caused by elastic deformation of the vibroisolating rubbers.

5. A double-deck elevator comprising:

an upper cage and a lower cage for accommodating passengers and vertically movable together in a hoistway provided in a building; and covers positioned so as to cover a space between the upper cage and the lower cage at a doorside, two lateral sides, and a backside of the space, wherein the covers and the cages are connected such that, at the point of connection, the outer surfaces of the covers and the cages are in the same plane, and said covers are provided with a plurality of vertically extending protrusions on outer surfaces thereof for guiding a vertical airflow flowing along the outer surfaces thereof, respectively.

6. The double-deck elevator according to claim 5, further comprising:

an upper airflow guiding member arranged above the upper cage for guiding an airflow into clearances between inner walls of the hoistway and outer side surfaces of the upper cage;

a lower airflow guiding member arranged below the lower cage for guiding an airflow into clearances between inner walls of the hoistway and outer side surfaces of the lower cage; and said upper and lower airflow guiding members being formed in a form of a capsule, respectively.

7. The double-deck elevator according to claim 6, further comprising noise absorbing members attached to at least one of the inner surfaces of the covers and the upper and lower airflow guiding members.

8. The double-deck elevator according to claim 6, further comprising:

an upper airflow guiding cone arranged on the upper air flow guiding member for guiding an airflow to the outer surfaces of the upper airflow guiding member; and a lower airflow guiding cone arranged below the lower airflow guiding member for guiding an airflow to the outer surfaces of the lower airflow guiding member.

9. The double-deck elevator according to claim 6, wherein said upper and lower airflow guiding members are provided with uneven serrations on the outer surfaces thereof respectively.

10. A double-deck elevator comprising:

an upper cage and a lower cage for accommodating passengers and vertically movable together in a hoistway provided in a building; and covers positioned so as to cover a space between the upper cage and the lower cage at a doorside, two lateral sides, and a backside of the space, wherein the covers and the cages are connected such that, at the point of connection, the outer surfaces of the covers and the cages are in the same plane, the doorside cover, which covers the doorside of the space, has a first portion extending downwardly from an end of an upper cage sill along a doorside inner wall of the hoistway, a second portion extending from a lower end of the first portion and curving into said space, and a third portion extending from a lower end of the second portion to a doorside end of a ceiling of the lower cage, and said covers are provided with a plurality of vertically extending protrusions on outer surfaces thereof for guiding a vertical airflow flowing along the outer surfaces thereof, respectively.

11. The double-deck elevator according to claim 10, further comprising:

an upper airflow guiding member arranged above the upper cage for guiding an airflow into clearances between inner walls of the hoistway and outer side surfaces of the upper cage;

a lower airflow guiding member arranged below the lower cage for guiding an airflow into clearances between inner walls of the hoistway and outer side surfaces of the lower cage; and said upper and lower airflow guiding members being formed in a form of a capsule, respectively.

12. The double-deck elevator according to claim 11, further comprising noise absorbing members attached to at least one of the inner surfaces of the covers and the upper and lower airflow guiding members.

13. The double-deck elevator according to claim 11, further comprising:

an upper airflow guiding cone arranged on the upper air flow guiding member for guiding an airflow to the outer surfaces of the upper airflow guiding member; and a lower airflow guiding cone arranged below the lower airflow guiding member for guiding an airflow to the outer surfaces of the lower airflow guiding member.

14. The double-deck elevator according to claim 11, wherein said upper and lower airflow guiding members are provided with uneven serrations on the outer surfaces thereof respectively.

* * * * *